US010823102B2

(12) United States Patent
Itaba et al.

(10) Patent No.: US 10,823,102 B2
(45) Date of Patent: Nov. 3, 2020

(54) CONTROL DEVICE FOR FUEL INJECTION VALVE

(71) Applicant: HITACHI AUTOMOTIVE SYSTEMS, LTD., Hitachinaka (JP)

(72) Inventors: Fumihiro Itaba, Hitachinaka (JP); Osamu Mukaihara, Hitachinaka (JP); Akiyasu Miyamoto, Hitachinaka (JP); Akira Iizuka, Hitachinaka (JP)

(73) Assignee: HITACHI AUTOMOTIVE SYSTEMS, LTD., Hitachinaka (JP)

( * ) Notice: Subject to any disclaimer, the term of this patent is extended or adjusted under 35 U.S.C. 154(b) by 0 days.

(21) Appl. No.: 16/496,251

(22) PCT Filed: Mar. 6, 2018

(86) PCT No.: PCT/JP2018/008460
§ 371 (c)(1),
(2) Date: Sep. 20, 2019

(87) PCT Pub. No.: WO2018/190035
PCT Pub. Date: Oct. 18, 2018

(65) Prior Publication Data

US 2020/0088123 A1 Mar. 19, 2020

(30) Foreign Application Priority Data

Apr. 14, 2017 (JP) ..... 2017-080599

(51) Int. Cl.
*F02D 41/20* (2006.01)
*F02D 41/30* (2006.01)
(Continued)

(52) U.S. Cl.
CPC ..... *F02D 41/3005* (2013.01); *F02M 51/061* (2013.01); *F02M 61/04* (2013.01); *F02M 61/14* (2013.01)

(58) Field of Classification Search
CPC ... F02D 41/3005; F02D 41/20; F02M 51/061; F02M 51/00; F02M 51/06; F02M 61/04; F02M 61/14
(Continued)

(56) References Cited

U.S. PATENT DOCUMENTS 10,240,551 B2 * 3/2019 Aono ..... F02D 41/2467
2011/0180046 A1 7/2011 Lehr
(Continued)

FOREIGN PATENT DOCUMENTS

JP 2006-132412 A 5/2006
JP 2010-512486 A 4/2010
(Continued)

OTHER PUBLICATIONS

International Search Report with English translation and Written Opinion issued in corresponding application No. PCT/JP2018/008460 dated Jul. 3, 2018.

*Primary Examiner* — Hai H Huynh
(74) *Attorney, Agent, or Firm* — Foley & Lardner LLP

(57) ABSTRACT

A control device for a fuel injection valve including a variable lift mechanism of two or more stages is provided. The control device includes an inflection point detection unit for detecting an inflection point from at least one of a drive current when the fuel injection valve is opened or a drive voltage when the fuel injection valve is closed. The control device also includes a drive sensing unit for sensing a drive lift of the fuel injection valve from at least one of an inflection point of a drive current during valve opening operation or a drive voltage during valve closing operation. The control device is configured to limit the command drive lift when the sensed drive lift is different from a command drive lift.

20 Claims, 15 Drawing Sheets

(51) Int. Cl.
*F02M 51/06* (2006.01)
*F02M 61/04* (2006.01)
*F02M 61/14* (2006.01)

(58) Field of Classification Search
USPC ..... 123/472, 478, 490, 494; 701/103–105, 701/115; 73/114.45, 114.47
See application file for complete search history.

(56) References Cited

U.S. PATENT DOCUMENTS

| | | | | |
|---|---|---|---|---|
| 2015/0377176 | A1 | 12/2015 | Hatanaka | |
| 2016/0076498 | A1 | 3/2016 | Aono | |
| 2016/0237937 | A1* | 8/2016 | Kusakabe ..... | F02D 41/247 |
| 2016/0245211 | A1 | 8/2016 | Katsurahara | |
| 2018/0209373 | A1 | 7/2018 | Yoshiume | |

FOREIGN PATENT DOCUMENTS

| | | | |
|---|---|---|---|
| JP | 2013-224630 | A | 10/2013 |
| JP | 2014-152697 | A | 8/2014 |
| JP | 2014-214837 | A | 11/2014 |
| JP | 2015-96720 | A | 5/2015 |
| JP | 2017-008945 | A | 1/2017 |
| JP | 2017-25803 | A | 2/2017 |

* cited by examiner

[FIG. 1]
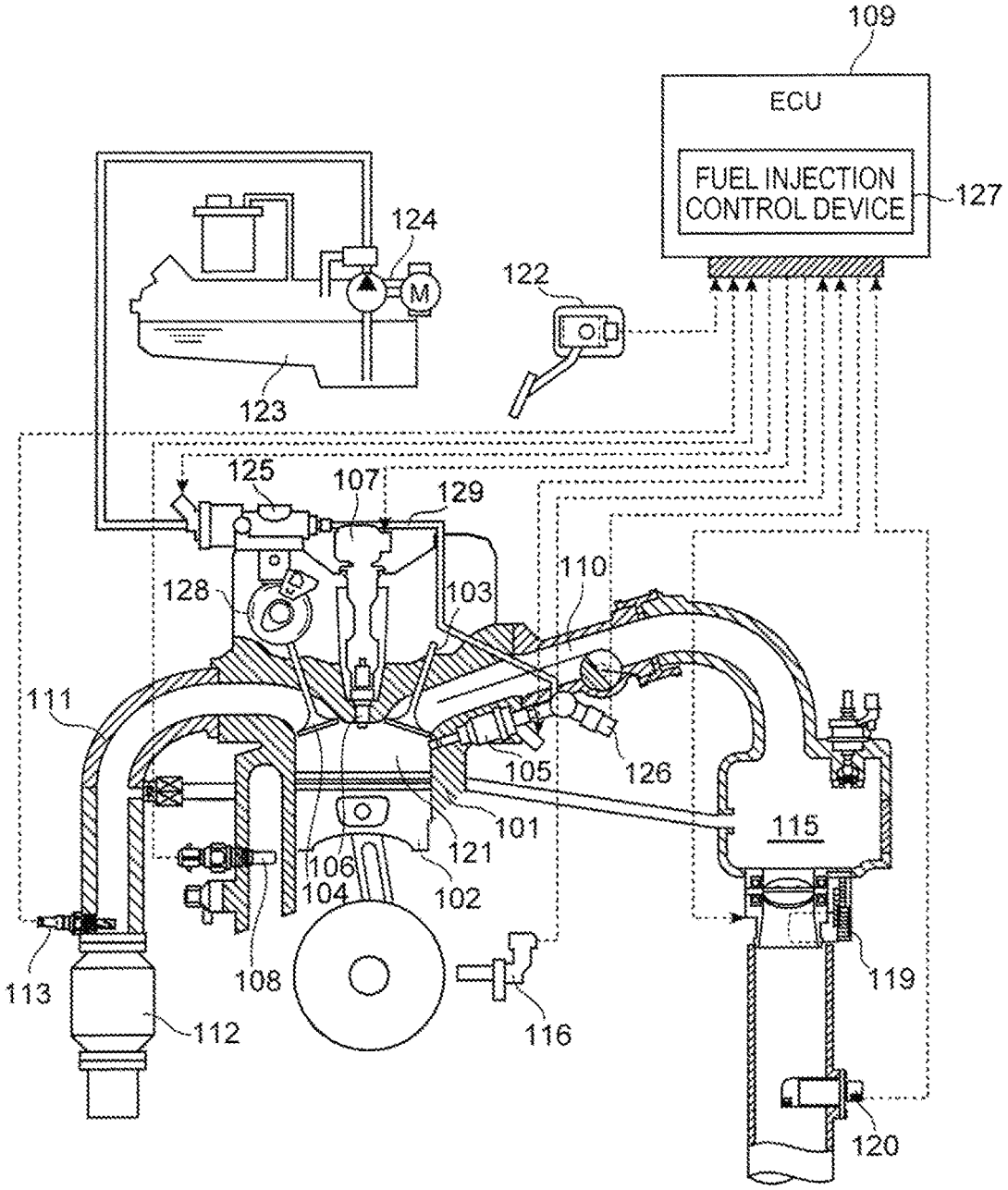

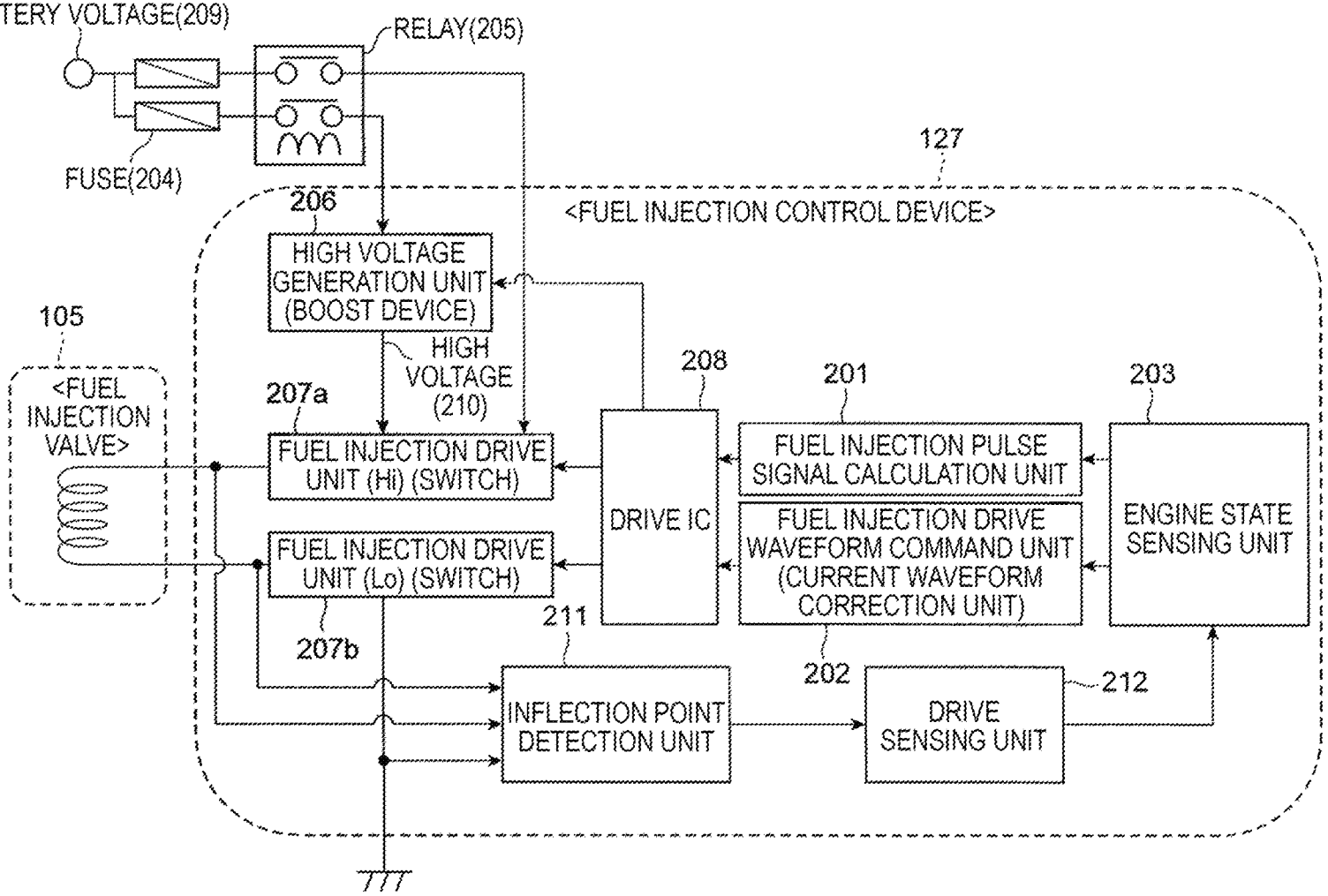
[FIG. 2]

[FIG. 3]
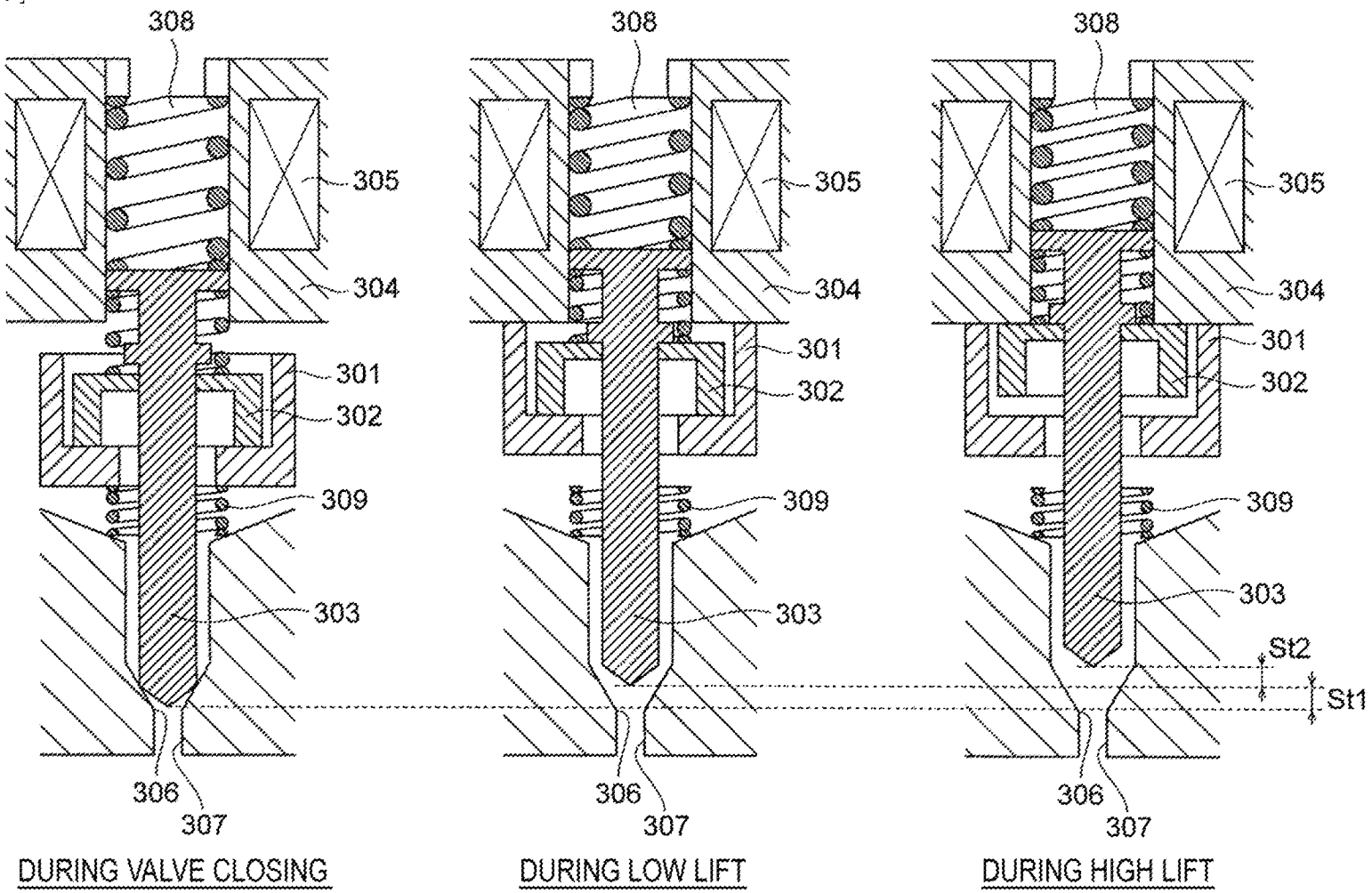

[FIG. 4]
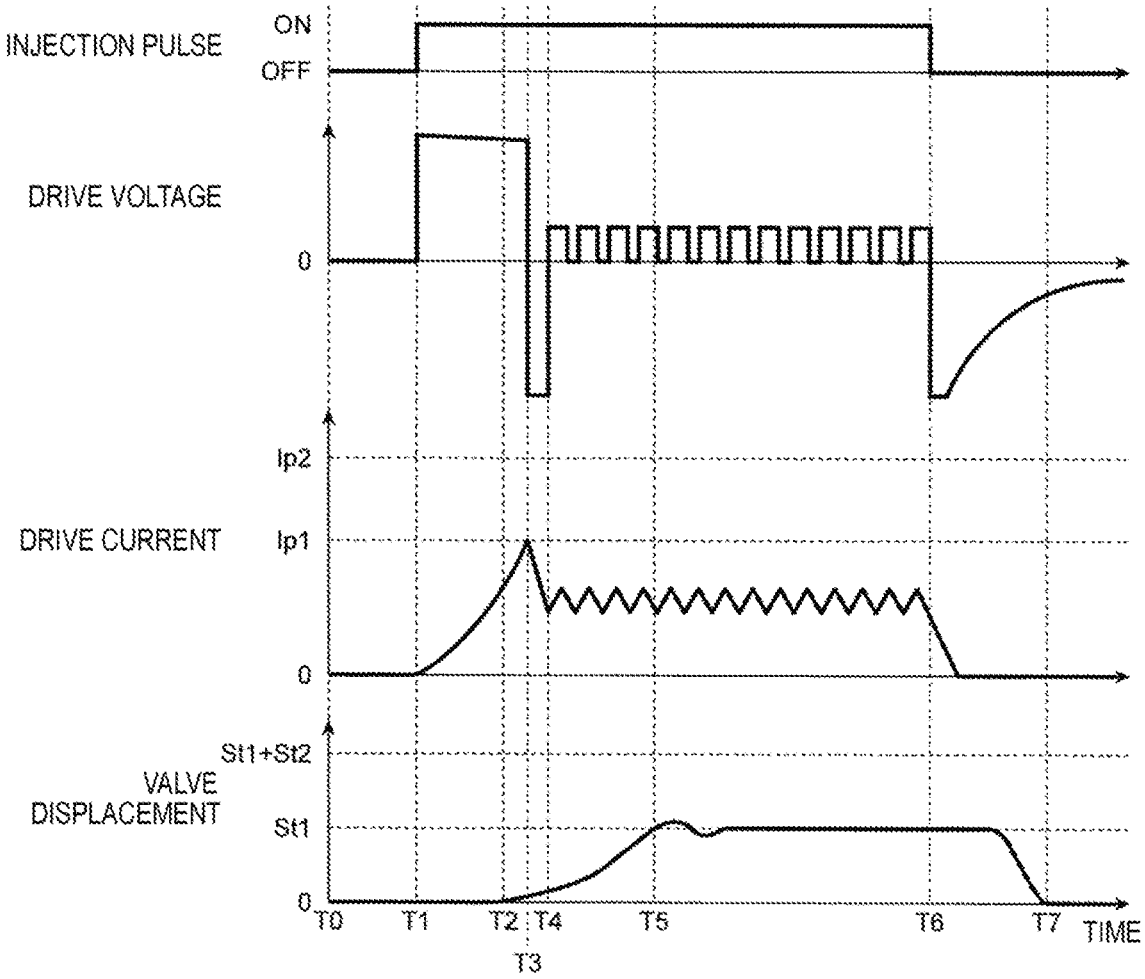

[FIG. 5]
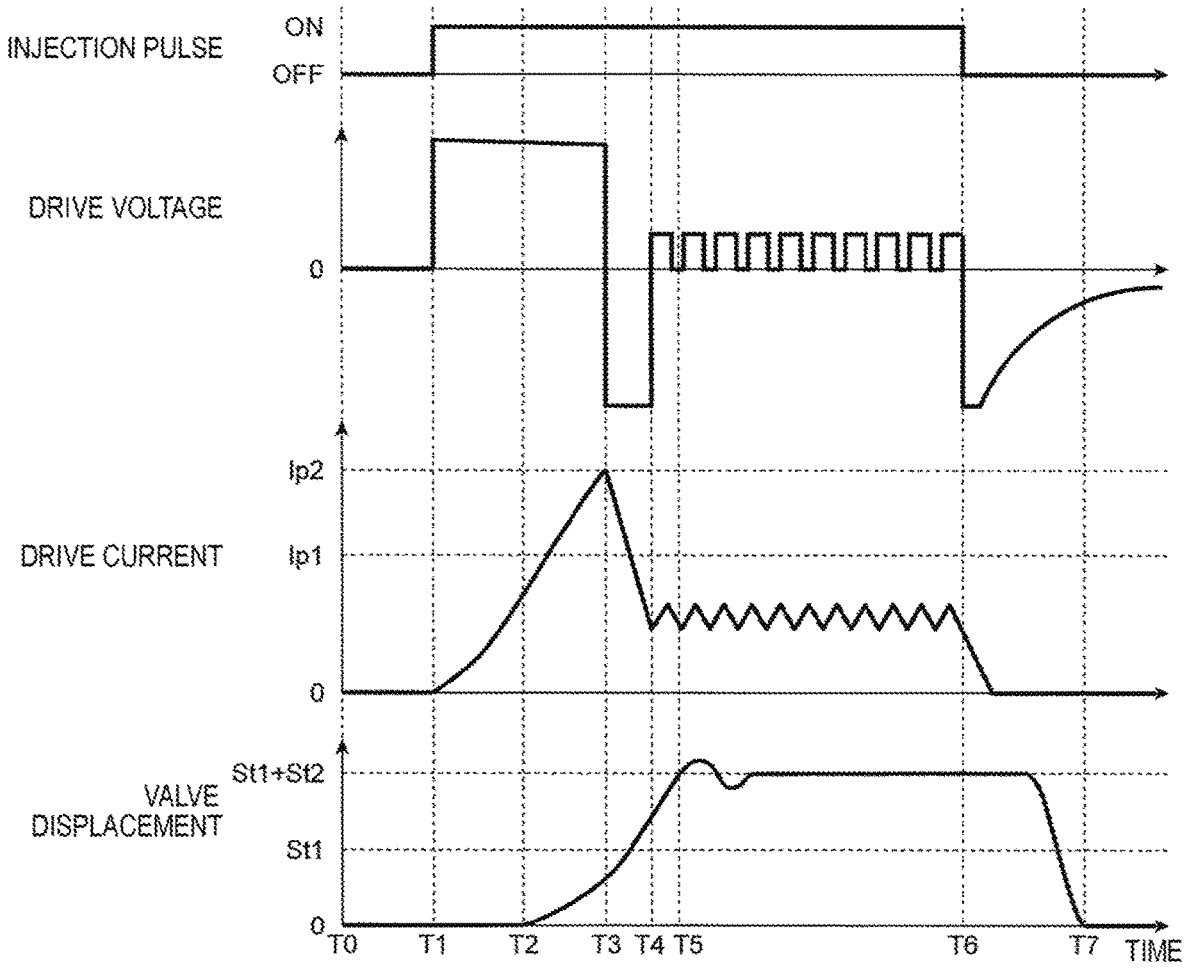

[FIG. 6]
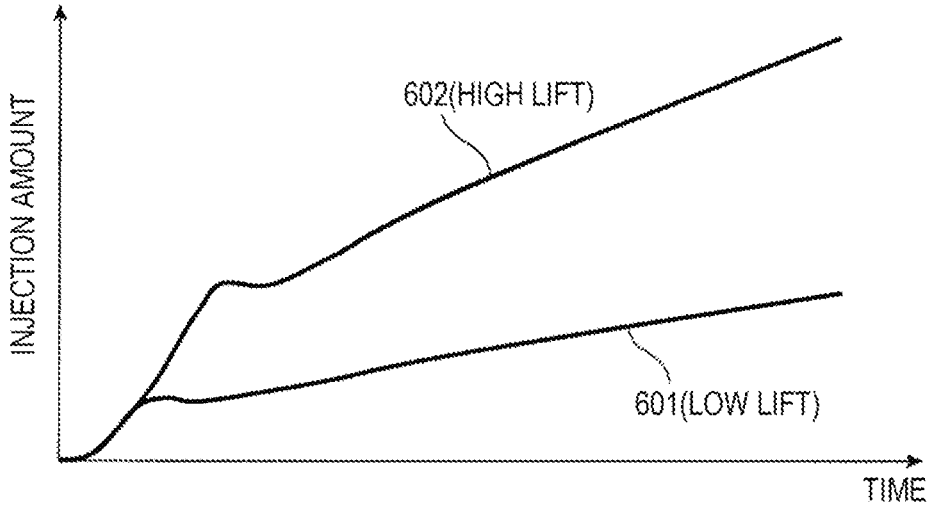
[FIG. 7]
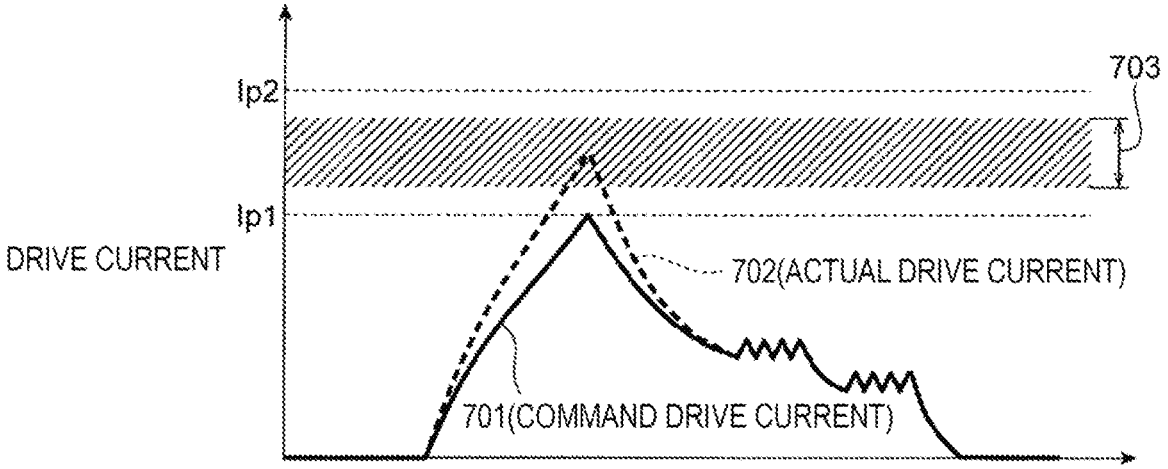

[FIG. 8]
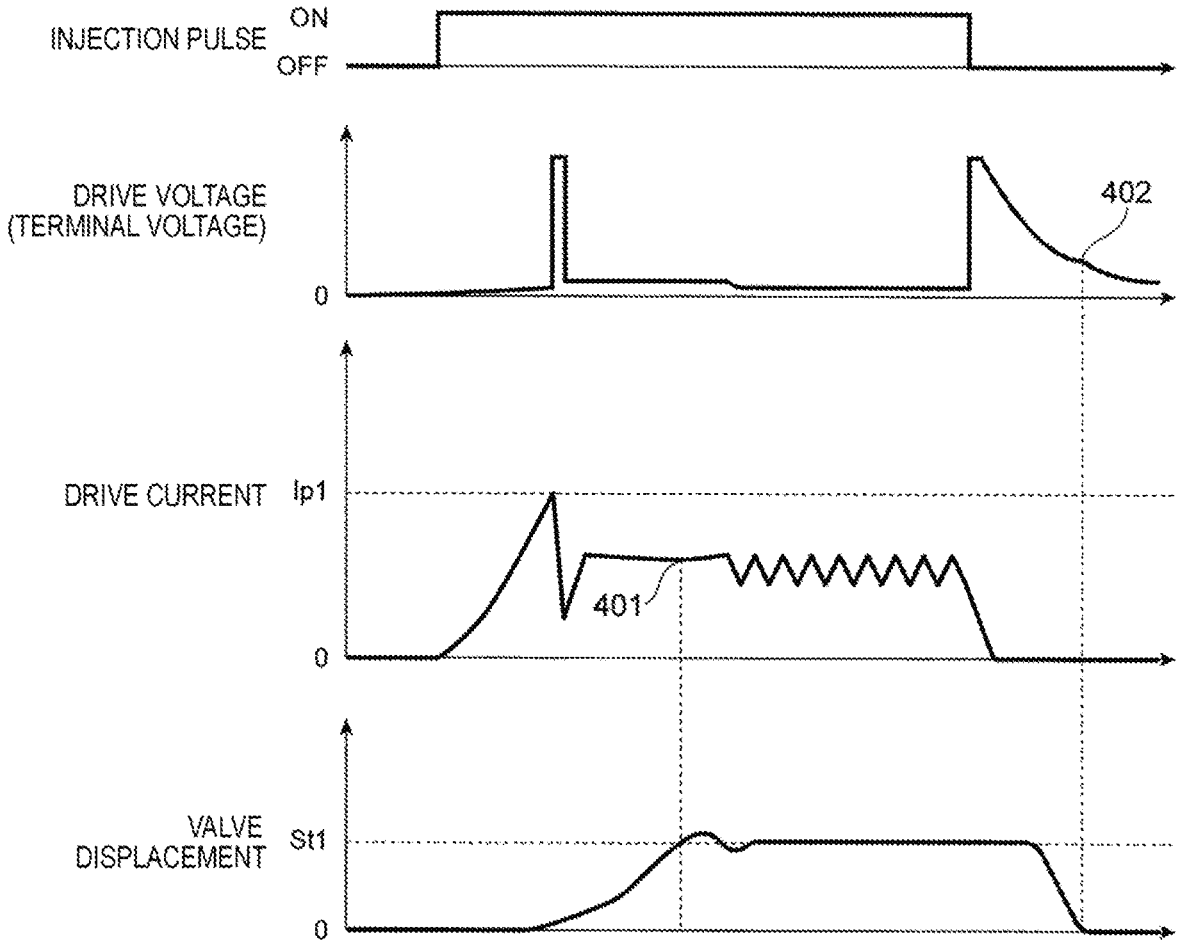

[FIG. 9]
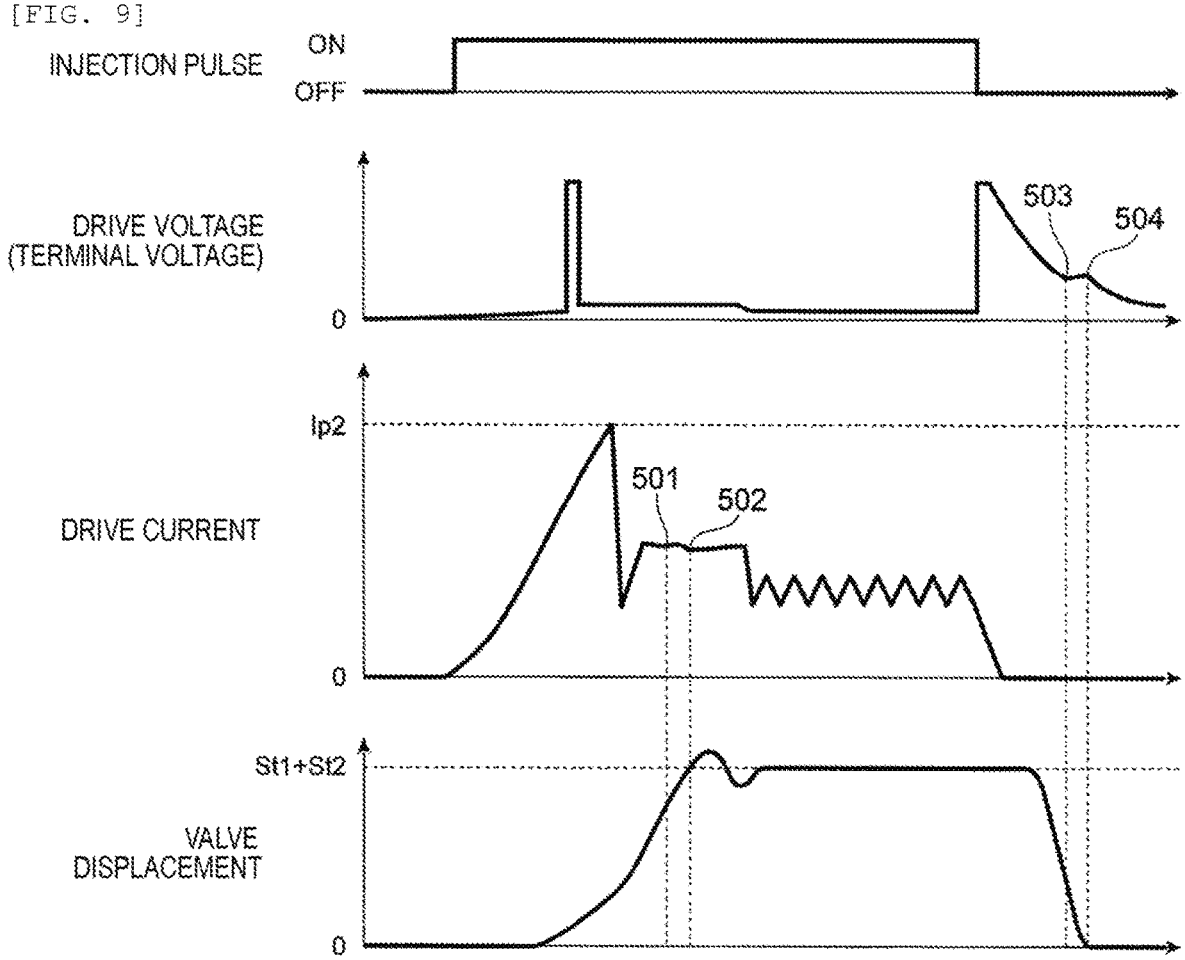

[FIG. 10]
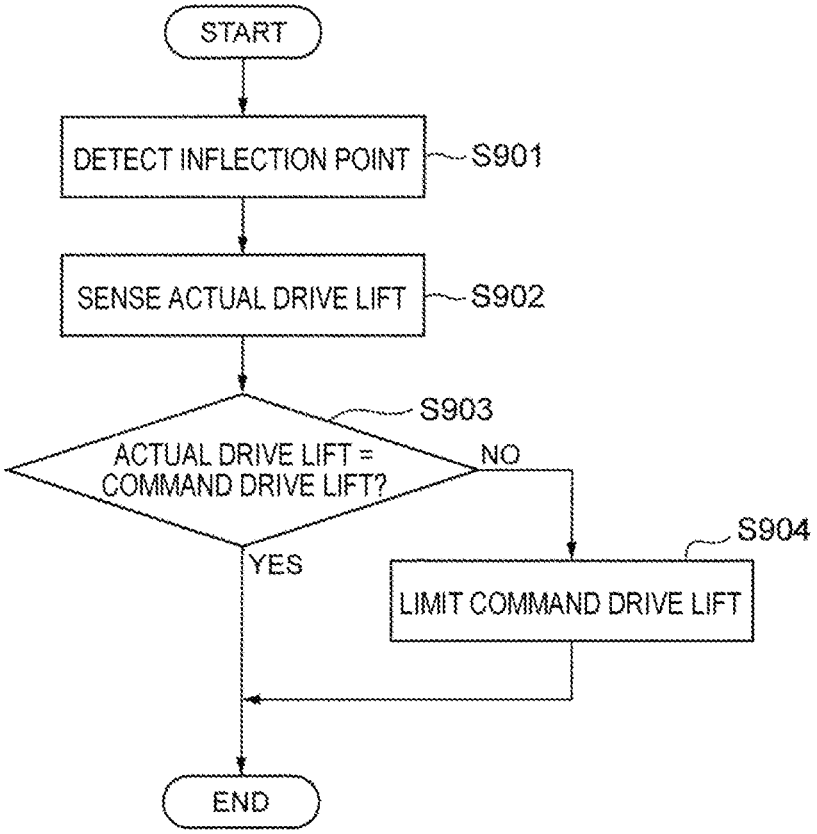
[FIG. 11]
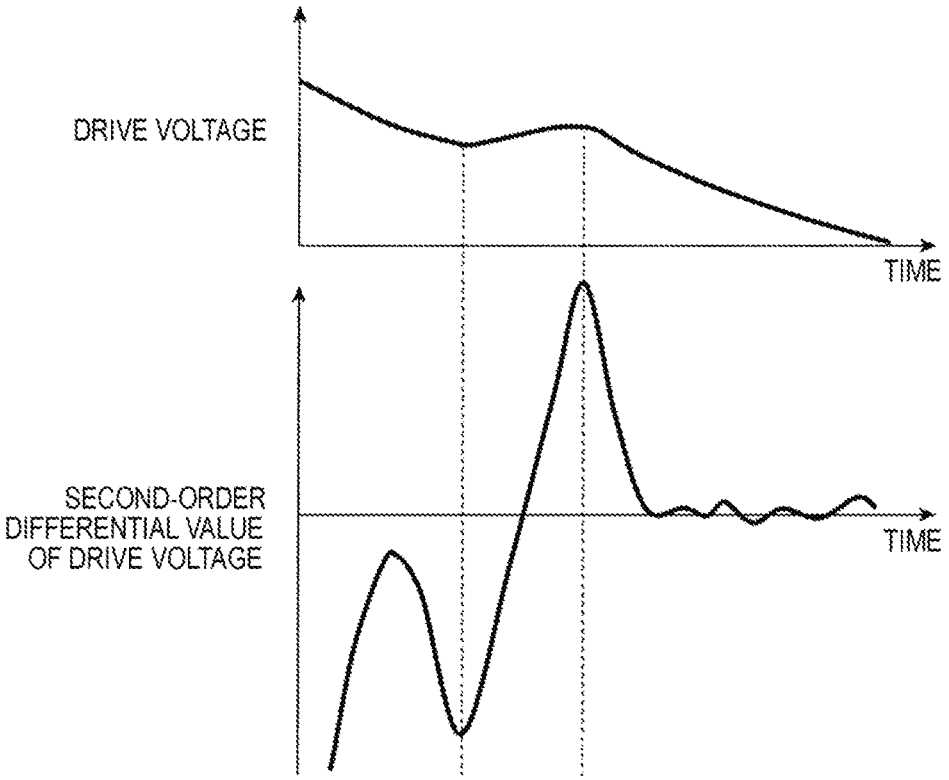

[FIG. 12]
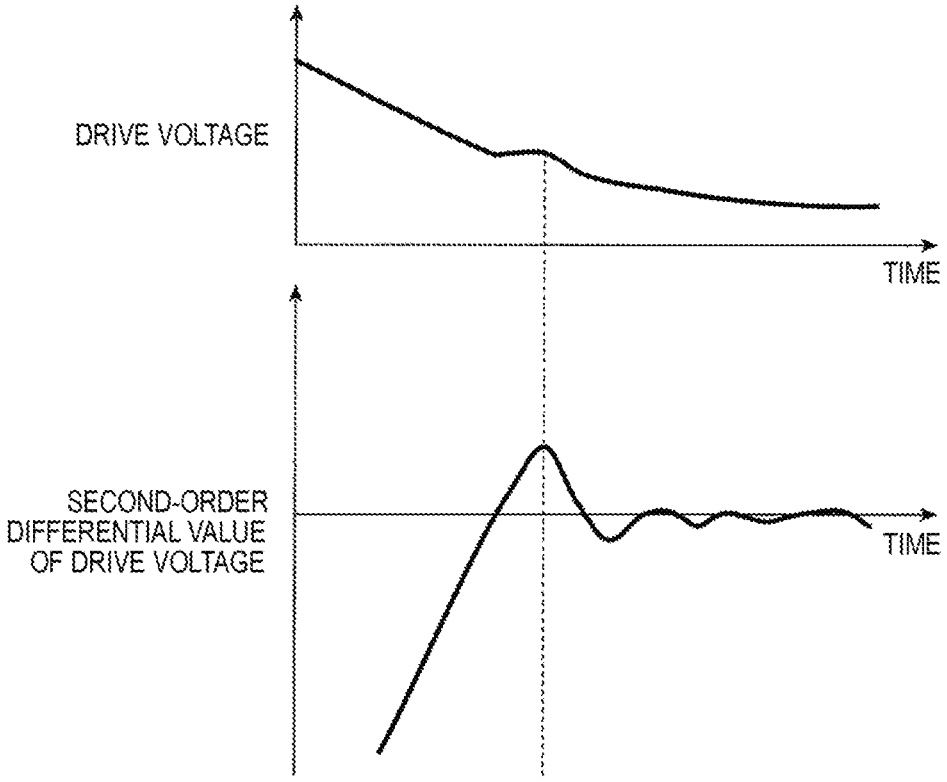
[FIG. 13]
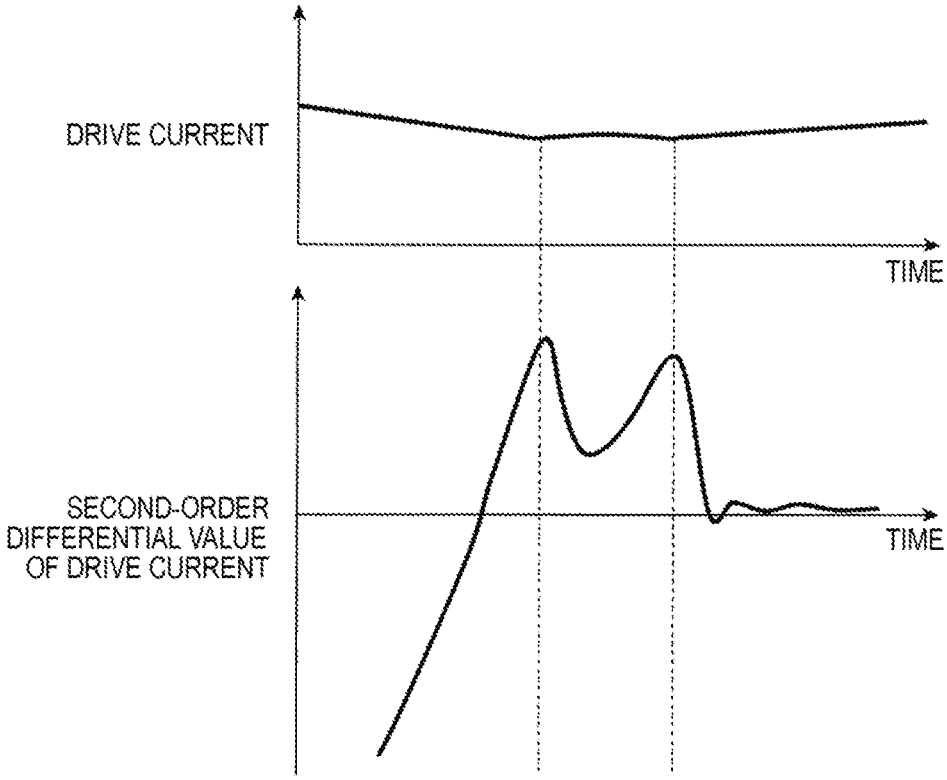

[FIG. 14]
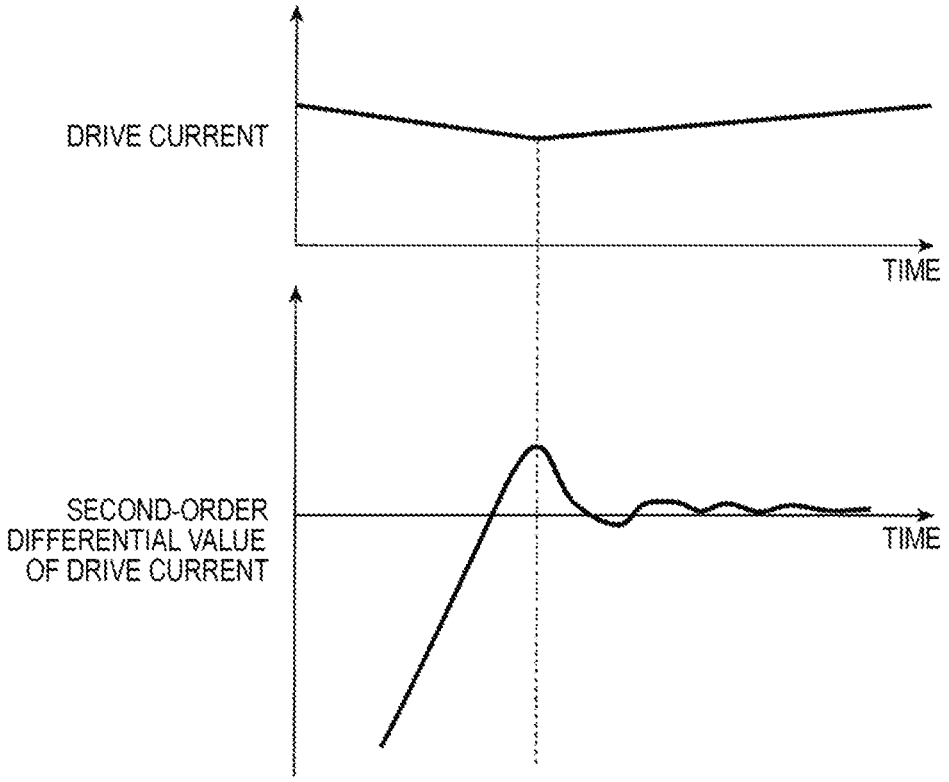

[FIG. 15]
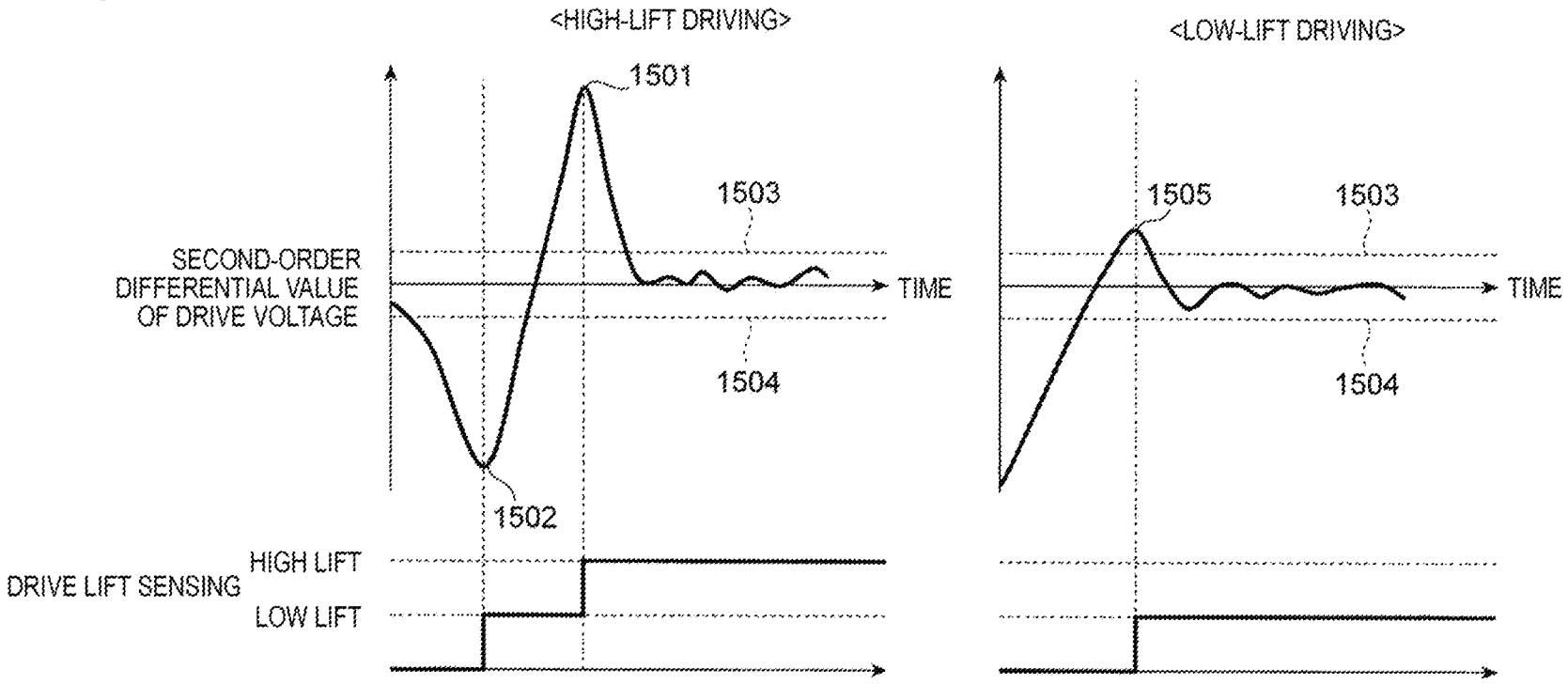

[FIG. 16]
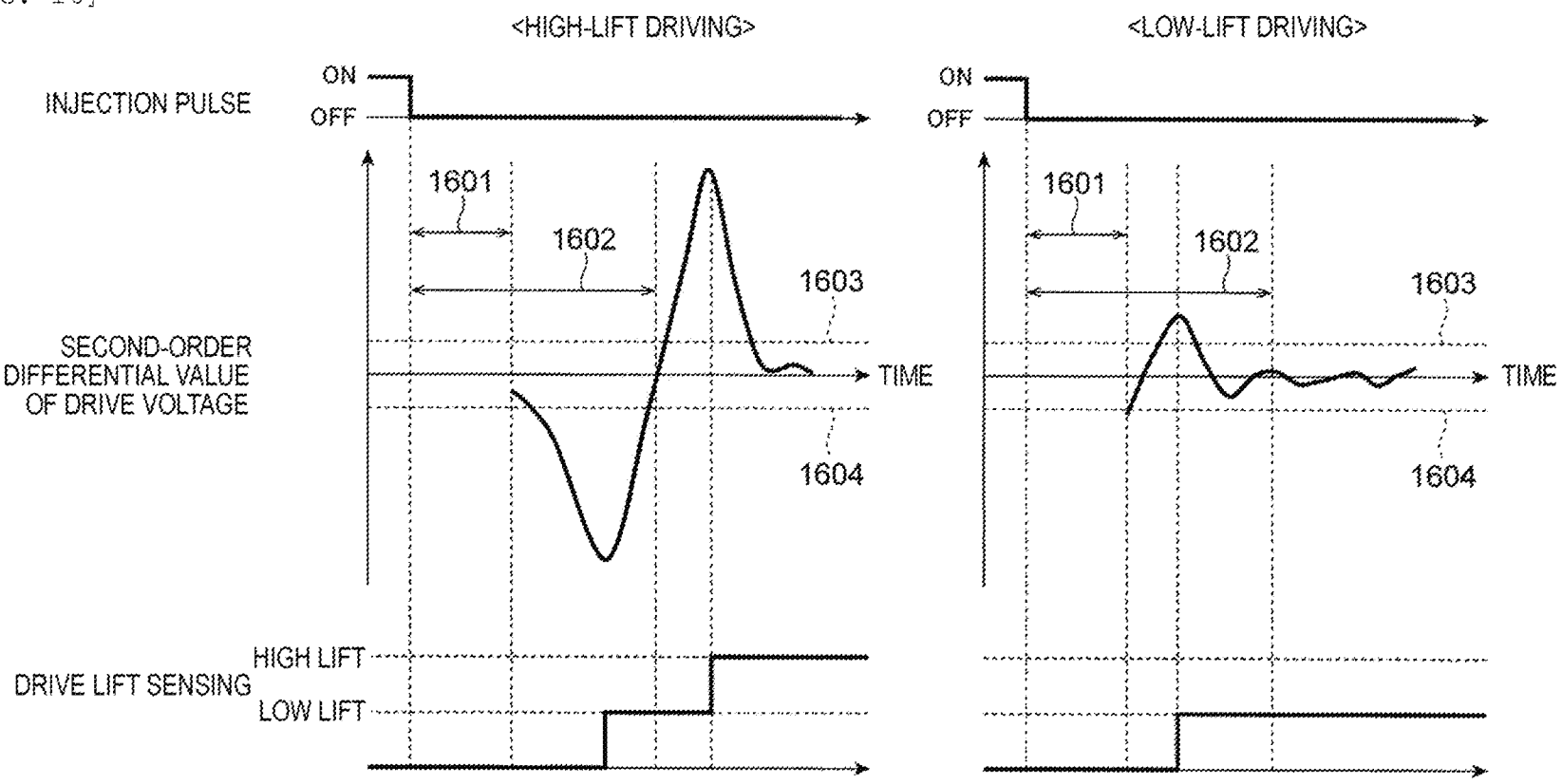

[FIG. 17]
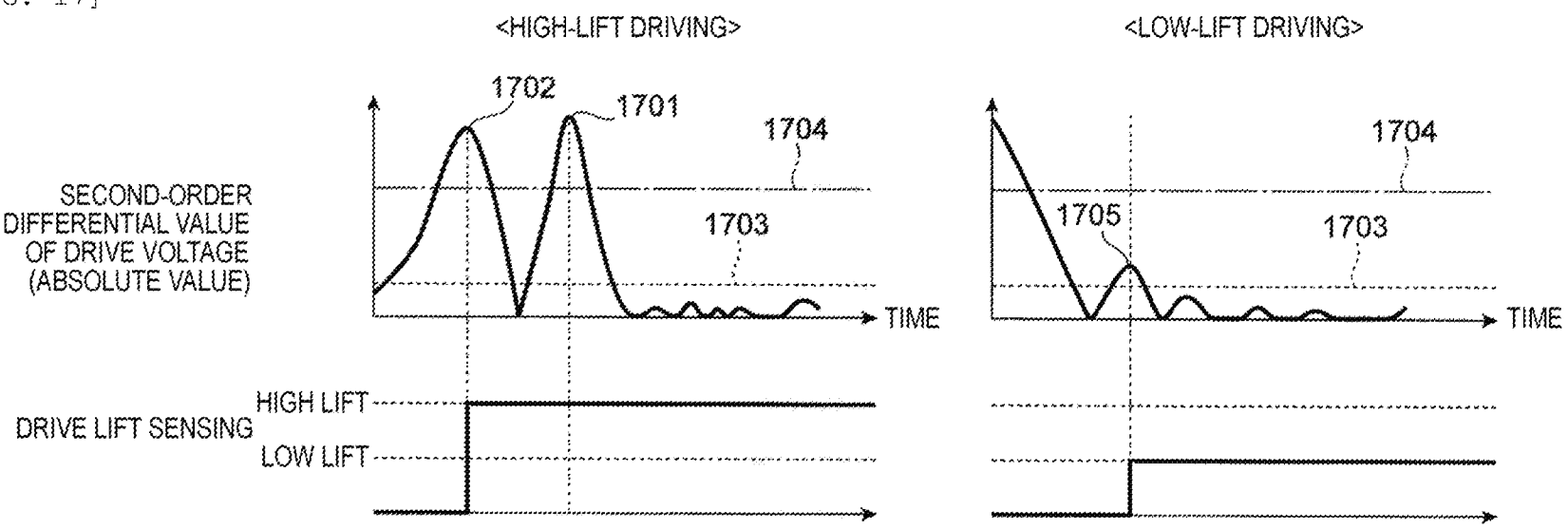

[FIG. 18]
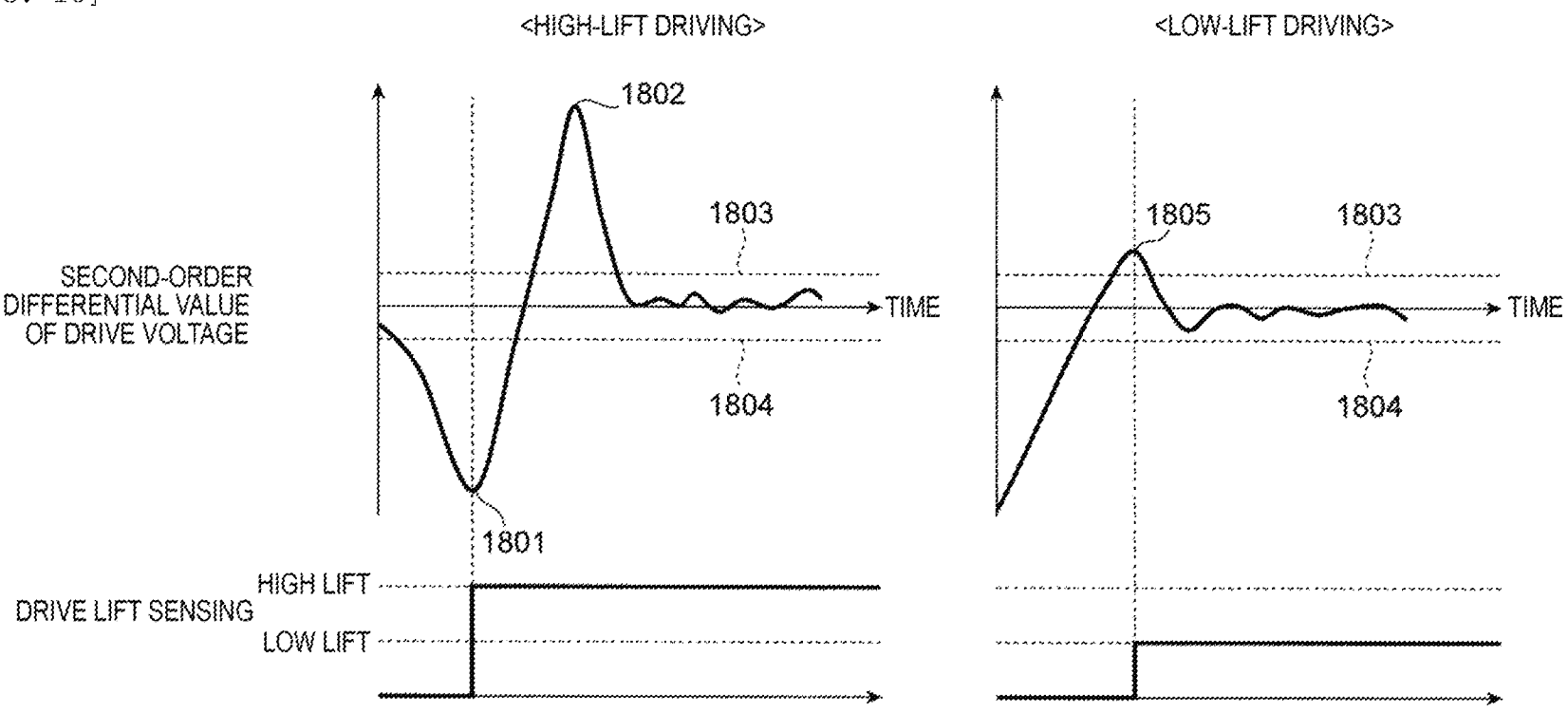

CONTROL DEVICE FOR FUEL INJECTION VALVE

TECHNICAL FIELD

The present invention relates to a control device for a fuel injection valve that injects and supplies fuel into an internal combustion engine.

BACKGROUND ART

The recently increased automobile fuel consumption and exhaust emission regulations require that low fuel consumption as well as high output of the internal combustion engine be achieved at the same time, and that the internal combustion engine be adapted for a wide operating range. As one of the means for achieving these, the expansion of the dynamic range of the fuel injection valve is required.

In order to expand the dynamic range of the fuel injection valve, it is necessary to improve the dynamic flow characteristics while ensuring the conventional static flow characteristics. As a method for improving the dynamic flow characteristics, reducing a minimum injection amount by half lift control is known.

It is known that this half lift control performs high-precision control in a state (hereinafter, referred to as a half lift region) before a valve body provided in the fuel injection valve completely reaches the valve opening position (hereinafter referred to as a full lift), but the variation in the injection amount in the half lift region is large due to individual differences of fuel injection valves. For this reason, various techniques for sensing individual differences occurring in each fuel injection valve have been proposed. For example, PTL 1 discloses a technique for indirectly sensing an individual difference relating to a valve opening operation of a fuel injection valve (specifically, a timing when a valve body is in a valve open state) based on electrical characteristics. Likewise, it is also a known technique to sense a valve closing operation of the fuel injection valve based on the electrical characteristics.

In addition, as a technique for expanding the dynamic range of a fuel injection valve, PTL 2 discloses a fuel injection valve that changes an injection amount (injection rate) per unit time by changing a lift amount of the valve body by two movable cores. The fuel injection valve can inject fuel with a full lift in the conventional half lift region, thereby increasing the injection amount accuracy at the time of small amount injection. Further, as such a control method, it is also disclosed that the lift amount is variable depending on a magnitude of a drive current flowing through the fuel injection valve.

CITATION LIST

Patent Literature

PTL 1: JP-A-2014-152697
PTL 2: JP-A-2006-132412

SUMMARY OF INVENTION

Technical Problem

However, a current value for controlling the lift amount of the fuel injection valve varies with respect to the commanded current value due to influence of variation in the machine difference in the fuel injection valve and the fuel injection control device that controls the fuel injection valve. Further, since the valve opening operation of the fuel injection valve is subject to influence of the fuel pressure, it is necessary to change the current value according to the fuel pressure value in order to control the lift amount. This fuel pressure value is generally measured using a fuel pressure sensor, but because pulsation arises in a common rail to which the fuel pressure sensor is attached, it is difficult to measure an accurate fuel pressure value at the time of fuel injection.

Therefore, there is a possibility that the current value flowing through the fuel injection valve varies due to the variation in the machine difference, the fluctuation of the fuel pressure, and the like described above, and the fuel injection valve operates with a lift amount different from the intended lift amount (that is, a command drive lift that is instructed to the fuel injection valve in accordance with the operation state of the internal combustion engine and the like) to inject fuel.

The present invention has been made in view of the above circumstances, and an object of the present invention is to provide a control device for a fuel injection valve, which can accurately monitor the lift amount (actual lift amount) of the fuel injection valve having the variable lift mechanism described above, and suppress deterioration of exhaust emissions and unintended torque fluctuations due to the deviation between the lift amount and the intended lift amount.

Solution to Problem

In order to achieve the above object, a control device for a fuel injection valve according to the present invention is a control device that controls a fuel injection valve having a variable lift mechanism that varies a lift amount of a valve body by a drive lift of two or more stages, and senses the drive lift of the fuel injection valve based on an inflection point detected from at least one of a drive current when the fuel injection valve is opened and a drive voltage when the fuel injection valve is closed.

In addition, a control device for a fuel injection valve according to the present invention is a control device that controls a fuel injection valve including a variable lift mechanism that varies a lift amount of a valve body by a drive lift of two or more stages, and includes an inflection point detection unit that detects an inflection point from at least one of a drive current when the fuel injection valve is opened and a drive voltage when the fuel injection valve is closed, and a drive sensing unit that senses the drive lift of the fuel injection valve based on the inflection point detected by the inflection point detection unit.

Advantageous Effects of Invention

According to the control device for a fuel injection valve according to the present invention, in the fuel injection valve that includes a variable lift mechanism that varies the lift amount by a drive lift of a plurality of stages, since the lift amount (actual drive lift) of the fuel injection valve can be accurately sensed, even when the fuel injection valve is driven with a lift amount different from the intended lift amount (command drive lift) due to a malfunction of the fuel injection valve or the like, it is possible to avoid significant deterioration of exhaust emission and unintended torque fluctuations.

The objects, configurations, and effects other than those described above will be clarified from the description of embodiments below.

BRIEF DESCRIPTION OF DRAWINGS

FIG. 1 is an overall configuration diagram showing an example of a basic configuration of an internal combustion engine equipped with a control device for a fuel injection valve (fuel injection control device) according to the present invention.

FIG. 2 is a basic configuration diagram showing the fuel injection control device shown in FIG. 1.

FIG. 3 is a main-part schematic diagram showing a structural example and an operation example of the fuel injection valve shown in FIG. 1.

FIG. 4 is a diagram for explaining a basic operation (low lift) of the fuel injection valve.

FIG. 5 is a diagram for explaining a basic operation (high lift) of the fuel injection valve.

FIG. 6 is a graph showing Ti-Q characteristics of the fuel injection valve.

FIG. 7 is a diagram for explaining a relationship between a command drive current and an actual drive current.

FIG. 8 is a diagram for explaining an inflection point at the time of low-lift driving.

FIG. 9 is a diagram for explaining an inflection point at the time of high-lift driving.

FIG. 10 is a flowchart for explaining a control flow of actual drive lift sensing and drive lift limitation by the fuel injection control device shown in FIG. 1.

FIG. 11 is a diagram showing an example of time series data of a drive voltage during a valve closing operation at the time of high-lift driving and a second-order differential value thereof.

FIG. 12 is a diagram showing an example of time series data of a drive voltage during a valve closing operation at the time of low-lift driving and a second-order differential value thereof.

FIG. 13 is a diagram showing an example of time series data of a drive current during a valve opening operation at the time of high-lift driving and a second-order differential value thereof.

FIG. 14 is a diagram showing an example of time series data of a drive current during a valve opening operation at the time of low-lift driving and a second-order differential value thereof.

FIG. 15 is a diagram for explaining actual drive lift sensing based on the number of inflection points.

FIG. 16 is a diagram for explaining actual drive lift sensing based on time to an inflection point.

FIG. 17 is a diagram for explaining actual drive lift sensing based on a magnitude of an extreme value at an inflection point.

FIG. 18 is a diagram for explaining actual drive lift sensing based on patterns of the inflection points.

DESCRIPTION OF EMBODIMENTS

Hereinafter, embodiments of a control device for a fuel injection valve (fuel injection control device) according to the present invention will be described with reference to the drawings.

In the present embodiment, a form in which as a fuel injection valve, an electromagnetic fuel injection valve which injects fuel into a combustion chamber of the internal combustion engine and includes a variable lift mechanism that varies a lift amount of the valve body by a drive lift of two stages (high lift and low lift) is adopted, and the fuel injection control device is used as a control device of an internal combustion engine is described, but it is needless to say that, as the fuel injection valve, an appropriate valve can be adopted, which is electromagnetically driven and includes a variable lift mechanism capable of varying the lift amount of the valve body by a drive lift of a plurality of stages (for example, three or more stages).

FIG. 1 shows an example of a basic configuration of an internal combustion engine equipped with a control device for a fuel injection valve (fuel injection control device) according to the present invention.

In FIG. 1, the air (intake air) taken into an internal combustion engine 101 passes through an air flow meter 120, is taken in the order of a throttle valve 119 and a collector 115, and then is supplied into a combustion chamber 121 through an intake pipe 110 and an intake valve 103 provided in each cylinder.

Meanwhile, the fuel is delivered from a fuel tank 123 to a high-pressure fuel pump 125 provided in the internal combustion engine 101 by a low-pressure fuel pump 124, and the high-pressure fuel pump 125 moves a plunger provided in the high-pressure fuel pump 125 up and down by power transmitted from an exhaust camshaft (not shown) provided in an exhaust cam 128 to pressurize (increase the pressure of) the fuel in the high-pressure fuel pump 125. Based on a control command value from an ECU 109, an open/close valve provided in an intake port is controlled with a solenoid so that the pressure of the fuel (fuel pressure) discharged from the high-pressure fuel pump 125 becomes a desired pressure.

As a result, the high-pressure fuel is delivered to a fuel injection valve 105 through a high-pressure fuel pipe 129, and the fuel injection valve 105 directly injects fuel into the combustion chamber 121 based on a command from a fuel injection control device 127 provided in the ECU 109.

Generally, the internal combustion engine 101 includes a fuel pressure sensor 126 for measuring the pressure in the high-pressure fuel pipe 129 in order to control the high-pressure fuel pump 125, and the ECU 109 performs so-called feedback control based on this sensor value so that the fuel pressure in the high-pressure fuel pipe 129 becomes a desired pressure. Further, the internal combustion engine 101 is configured such that an ignition coil 107 and a spark plug 106 are provided for each combustion chamber 121, and, by the ECU 109, energization control on the ignition coil 107 and ignition control by the spark plug 106 are performed at a desired timing.

As a result, an air-fuel mixture in the combustion chamber 121 in which the intake air and the fuel are mixed is burned by the spark emitted from the spark plug 106, and a piston 102 is pushed down by this pressure. An exhaust gas generated by the burning is exhausted to an exhaust pipe 111 through an exhaust valve 104, and a three-way catalyst 112 for purifying the exhaust gas is provided on the exhaust pipe 111.

The ECU 109 incorporates the fuel injection control device 127 described above, and receives signals from a crank angle sensor 116 that measures an angle of a crankshaft (not shown) in the internal combustion engine 101, the air flow meter 120 that indicates the intake air amount, an oxygen sensor 113 that measures an oxygen concentration in the exhaust gas, an accelerator opening sensor 122 that indicates a degree of opening of an accelerator operated by a driver, the fuel pressure sensor 126, and the like.

According to the further description of the signals input from each sensor, the ECU 109 calculates a required torque of the internal combustion engine 101 based on the signal of the accelerator opening sensor 122 and determines whether or not the engine is in an idle state. In addition, the ECU 109 is provided with a rotational speed measuring means for calculating a rotational speed of the internal combustion engine 101 (hereinafter referred to as an engine speed) based on signals of the crank angle sensor 116, a means for determining whether or not the three-way catalyst 112 is warmed up based on a coolant temperature of the internal combustion engine 101 obtained from a water temperature sensor 108, and an elapsed time since the start of the internal combustion engine 101, and the like.

Further, the ECU 109 calculates an amount of intake air necessary for the internal combustion engine 101 based on the required torque of the internal combustion engine 101 described above, and outputs an opening signal in accordance with the amount of intake air to the throttle valve 119, and the fuel injection control device 127 calculates a fuel amount in accordance with the amount of intake air, outputs a fuel injection signal corresponding to the fuel amount to the fuel injection valve 105, and further outputs an ignition signal to the ignition coil 107.

Next, the fuel injection control device 127 of the ECU 109 and the fuel injection valve 105 shown in FIG. 1 will be described with reference to FIG. 2.

The fuel injection control device 127 basically includes, as a fuel injection control unit, a fuel injection pulse signal calculation unit 201, a fuel injection drive waveform command unit (current waveform correction unit) 202, an engine state sensing unit 203, a drive sensing unit 212, an inflection point detection unit 211, a drive IC 208, a high voltage generation unit (boost device) 206, and fuel injection drive units (switches) 207*a* and 207*b*.

The engine state sensing unit 203 collects and provides various information such as the engine speed, the amount of intake air, the coolant temperature, the fuel temperature and a failure state of the internal combustion engine (engine), and based on various information obtained from the engine state sensing unit 203, the fuel injection pulse signal calculation unit 201 calculates an injection pulse (width) that defines a fuel injection period of the fuel injection valve 105, and the fuel injection drive waveform command unit 202 calculates a command value of the drive current supplied to open the fuel injection valve 105 or maintain the opening, and outputs the command value to the drive IC 208.

The high voltage generation unit 206 generates a high power supply voltage (hereinafter referred to as a high voltage) 210 required when the electromagnetic solenoid-type fuel injection valve 105 is opened using, as a source, a battery voltage 209 supplied through a fuse 204 and a relay 205. Further, the high voltage generation unit 206 boosts the battery voltage 209 to a desired target high voltage based on a command from the drive IC 208. As a result, as a power supply of the fuel injection valve 105, a duel system is provided, which includes a high voltage 210 for the purpose of ensuring a valve opening force of the valve body, and the battery voltage 209 that maintains the valve open so as to prevent the valve body from closing after opening of the valve.

The two fuel injection drive units 207*a* and 207*b* are provided on the upstream side and the downstream side of the fuel injection valve 105, and supply a drive current to the fuel injection valve 105. The drive IC 208 controls the high voltage 210 or battery voltage 209 applied to the fuel injection valve 105, by switching the fuel injection drive units 207*a* and 207*b* which are the switches based on the injection pulse (width) calculated by the fuel injection pulse signal calculation unit 201 and the drive current waveform calculated by the fuel injection drive waveform command unit 202, to control the drive current supplied to the fuel injection valve 105.

The injection pulse output from the fuel injection pulse signal calculation unit 201, the drive voltage and the drive current which are calculated by the fuel injection drive waveform command unit 202 and applied to the fuel injection valve 105, and an amount of displacement of a valve body 303 of the fuel injection valve 105 will be described with reference to FIGS. 3, 4, and 5.

FIG. 3 shows a configuration example and an operation example of a fuel injection valve including a two-stage variable lift mechanism, in which the diagram on the left side in FIG. 3 shows the valve in a closed state, the diagram in the center in FIG. 3 shows an example (hereinafter referred to as a low lift) in which a tip of the valve body 303 is separated away from a valve seat 306 by St1 to form a fuel passage, and the diagram on the right side in FIG. 3 shows an example (hereinafter referred to as a high lift) in which the tip of the valve body 303 is separated away from the valve seat 306 by St1+St2 to form a fuel passage.

FIGS. 4 and 5 show, in time series, examples of the injection pulse, the drive voltage, the drive current, and the displacement of the valve body 303 (valve displacement) when fuel is injected from the fuel injection valve 105, FIG. 4 shows the example of driving with a low lift, and FIG. 5 shows the example of driving with a high lift.

First, driving with the low lift (low-lift driving) will be described with reference to the left and center diagrams of FIG. 3 and FIG. 4.

From Time T0 to Time T1, since the injection pulse output from the fuel injection pulse signal calculation unit 201 is in an OFF state, the fuel injection drive units 207*a* and 207*b* are in the OFF state and no drive current is supplied to the fuel injection valve 105. Therefore, as shown in the left diagram of FIG. 3, the valve body 303 is biased in the valve closing direction of the valve seat 306 by a biasing force of a set spring 308 of the fuel injection valve 105, a lower end of the valve body 303 remains in contact with the valve seat 306 (a valve hole 307 remains closed), and fuel is not injected.

Next, at Time T1, the injection pulse is turned on, the fuel injection drive unit (Hi) 207*a* and the fuel injection drive unit (Lo) 207*b* are turned on, and when the high voltage 210, the fuel injection valve 105, and a ground voltage are electrically connected (the drive voltage applied to the solenoid 305 is the high voltage 210), and a drive current is supplied to the solenoid 305, a magnetic flux is generated between a fixed core 304 and a movable core 1 301, and a magnetic attractive force acts on the movable core 1 301. When the drive current supplied to the solenoid 305 increases and the magnetic attractive force acting on the movable core 1 301 exceeds the biasing force of a zero spring 309, the movable cores 1 and 2 301 and 302 start to move while being attracted in the direction of the fixed core 304 (Time T1 to Time T2).

When the movable core 1 301 and the movable core 2 302 are moved by a predetermined length, the movable core 2 302 and the valve body 303 are engaged with each other, the movable cores 1 and 2 301 and 302 and the valve body 303 as one body start to move together (with the movable core 2 302 pushing up the valve body 303) (Time T2), and the valve body 303 is moved away from the valve seat 306 so that the valve is opened and fuel is injected.

The movable cores 1 and 2 301 and 302 and the valve body 303 are moved together as one body until the movable core 1 301 is collided against the fixed core 304, and when the movable core 1 301 and the fixed core 304 are vigorously collided against each other, the movable core 1 301 rebounds from the fixed core 304, which disturbs the flow rate of fuel injected from the valve hole 307. Therefore, before the movable core 1 301 is collided against the fixed core 304 (Time T3), that is, when the drive current reaches a peak current Ip1, the fuel injection drive units 207*a* and 207*b* are turned off, and the drive voltage applied to the solenoid 305 is decreased to decrease the drive current so that the momentum of the movable core 1 301 and the valve body 303 is reduced.

From Time T4 until Time T6 when the injection pulse falls, while the fuel injection drive unit (Lo) 207*b* is maintained in an ON state so as to supply only a magnetic attractive force that is sufficient to attract the movable core 1 301 to the fixed core 304, the fuel injection drive unit (Hi) 207*a* is intermittently turned on (the fuel injection drive unit (Hi) 207*a* is subject to PMW control), and the drive voltage applied to the solenoid 305 is intermittently set to the battery voltage 209 so that the drive current flowing through the solenoid 305 is controlled to be within a predetermined range.

At Time T5 before Time T6, the movable core 1 301 and the fixed core 304 are collided against each other, and the valve body 303 is displaced by a lift amount St1.

At Time T6, when the injection pulse is turned off, the fuel injection drive units 207*a* and 207*b* are both turned off, the drive voltage applied to the solenoid 305 is decreased, and the drive current flowing through the solenoid 305 is decreased so that the magnetic flux generated between the fixed core 304 and the movable core 1 301 gradually disappears, and the magnetic attractive force acting on the movable core 1 301 disappears. Therefore, the valve body 303 is pushed back in the valve closing direction of the valve seat 306 with a predetermined time delay due to the biasing force of the set spring 308 and the pressing force of the fuel pressure. Then, at Time T7, the valve body 303 is returned to the original position, the lower end of the valve body 303 comes into contact with the valve seat 306, and thus the valve is closed and fuel is not injected.

Moreover, from Time T6 when the injection pulse is turned off, high voltage 210 is supplied in a direction opposite to the direction when driving the fuel injection valve 105 so that the residual magnetic force in the fuel injection valve 105 is quickly removed and the valve body 303 is closed early.

Next, driving with high-lift (high-lift driving) will be described with reference to the left and right diagrams of FIG. 3 and FIG. 5. The description which overlaps with that in the case of the low lift described above is not repeated.

When the injection pulse is turned on at Time T1, the high voltage 210, the fuel injection valve 105, and the ground voltage are electrically connected (the drive voltage applied to the solenoid 305 is the high voltage 210), a magnetic attractive force acts on the movable core 1 301 and the movable core 2 302, and the movable core 1 301 and the movable core 2 302 start to move while being attracted in the direction of the fixed core 304 (Time T1 to Time T2).

When the movable core 1 301 and the movable core 2 302 are moved by a predetermined length, the movable core 2 302 and the valve body 303 are engaged with each other, the movable core 1 301, the movable core 2 302, and the valve body 303 as one body start to move together (Time T2), and then the movable core 1 301 having a short distance from the fixed core 304 is collided against the fixed core 304. Thereafter, the movable core 2 302 and the valve body 303 are moved together (with the movable core 2 302 pushing up the valve body 303) until the movable core 2 302 is collided against the fixed core 304, and when the valve body 303 is displaced from the valve seat 306 by the lift amount of St1+St2, the movable core 2 302 is collided against the fixed core 304.

Before the movable core 2 302 is collided against the fixed core 304 (Time T3), that is, when the drive current reaches a peak current Ip2 (Ip2>Ip1), the drive voltage applied to the solenoid 305 is decreased to decrease the drive current so that the momentum of the movable core 2 302 and the valve body 303 is reduced.

From Time T4 until Time T6 when the injection pulse falls, as in the case of the low lift, the drive voltage is intermittently set to the battery voltage 209 to maintain the valve open state, and the drive current flowing through the solenoid 305 is controlled to be within a predetermined range.

At Time T6, when the injection pulse is turned off, the magnetic attractive force acting on the movable core 1 301 and the movable core 2 302 disappears, and the valve body 303 is pushed down to the valve seat 306 so that the valve is closed.

FIG. 6 is a diagram showing an injection amount characteristic (Ti-Q characteristic) when the fuel injection valve 105 is driven with a high lift and a low lift.

As described above, as for the low lift, since the displacement amount of the valve body 303 is St1, a Ti-Q characteristic 1 601 shown in FIG. 6 is obtained, and it is possible to ensure the linearity of the injection amount with respect to the injection pulse width for even the small amount injection area. Meanwhile, as for the high lift, the displacement amount of the valve body 303 is displaced by St1+St2. Accordingly, a Ti-Q characteristic 2 602 shown in FIG. 6 is obtained for the high lift, and a relatively large amount of fuel may be injected compared to the low lift with the same injection pulse width.

By measuring the Ti-Q characteristics by experiments and storing these in advance in a map, the injection pulse width for the required injection amount may be calculated. In addition, the Ti-Q characteristics vary also according to a fuel pressure. As the fuel pressure increases, the injection amount increases with respect to the valve opening time, and as the fuel pressure decreases, the injection amount decreases. Therefore, it is necessary to correct the Ti-Q characteristic according to the fuel pressure value measured by the fuel pressure sensor 126 (see FIG. 1). It is preferable that the correction value is measured in advance by experiments or the like and the injection pulse is calculated by multiplying the injection pulse width determined by using the required injection amount by the correction value.

As described above, when the required injection amount is small and high accuracy is required, the fuel injection valve 105 is driven by flowing the peak current Ip1 shown in FIG. 4 through the solenoid 305. Meanwhile, when it is necessary to inject a high volume of fuel in a short time, the lift amount of the fuel injection valve 105 may be controlled appropriately by flowing the peak current Ip2 (Ip1<Ip2) shown in FIG. 5 through the solenoid 305.

However, as shown in FIG. 7, a command drive current value 701 calculated by the fuel injection drive waveform command unit 202 is subject to influence by the variation in the machine difference of the fuel injection control device 127, and the like, such that, when flowing actually through the solenoid 305, an error occurs with respect to the drive current value calculated by the fuel injection drive waveform command unit 202. In addition, due to the variation in the machine difference of the fuel injection valve 105, there is a region 703 in which the drive current value is not uniquely determined between high-lift driving and low-lift driving, and when the actual drive current 702 that actually flows through the solenoid 305 reaches the value in the region 703, the actual drive lift (actual drive lift) may be driven with a lift amount different from the command drive lift (drive lift instructed from the engine state sensing unit 203 according to the operation state of the internal combustion engine 101). When the fuel injection valve 105 is driven with a lift amount different from the command drive lift, there is a possibility that the required fuel injection amount is too small or too large, and thus deterioration of exhaust emission and rotational variation of the internal combustion engine 101 are caused. For this reason, when the actual drive lift is sensed and monitored and the actual drive lift is different from the command drive lift, it is necessary to appropriately control the fuel injection valve 105.

The sensing of whether the fuel injection valve 105 described above is driven with the high lift or the low lift may be performed by detecting an inflection point that appears in the drive current during the valve opening operation of the fuel injection valve 105 or by detecting an inflection point that appears in the drive voltage during the valve closing operation thereof.

Therefore, as shown in FIG. 2, the inflection point detection unit 211 of the fuel injection control device 127 detects the inflection point from the drive current during the valve opening operation of the fuel injection valve 105 or from the drive voltage during the valve closing operation thereof, and the drive sensing unit 212 senses the drive lift (lift amount) of the fuel injection valve 105 based on the detection result of the inflection point detection unit 211, and outputs the sensed result to the engine state sensing unit 203.

First, the inflection point appearing in the drive current due to the opening operation of the fuel injection valve 105 and the inflection point appearing in the drive voltage due to the valve closing operation will be outlined.

As described above, when the valve body 303 of the fuel injection valve 105 is opened, a high voltage 210 is applied to the solenoid 305, and a relatively large drive current flows to accelerate the movable cores 1 and 2 301 and 302 and the valve body 303. Next, after the high voltage 210 applied to the solenoid 305 is cut off and the drive current flowing through the solenoid 305 is decreased to a predetermined value, when the battery voltage 209 is applied to the solenoid 305, the movable cores 1 and 2 301 and 302 are collided against the fixed core 304 in a state in which the drive current stably flows through the solenoid 305. When the movable cores 1 and 2 301 and 302 are collided against the fixed core 304, the acceleration of the movable cores 1 and 2 301 and 302 is changed, and the inductance of the solenoid 305 is changed.

Here, while the change in inductance of the solenoid 305 is considered to appear as an inflection point in the drive current flowing through the solenoid 305 or the drive voltage applied to the solenoid 305, since the voltage is maintained almost constant at the time of opening the valve, the inflection point does not appear in the drive voltage, but appears in the drive current.

Meanwhile, at the time of closing the valve body 303 of the fuel injection valve 105, when the valve body 303 is collided against the valve seat 306, the zero spring 309 is changed from expansion to compression, and when the movement direction of the movable cores 1 and 2 301 and 302 is reversed, the acceleration is changed and the inductance of the solenoid 305 is changed. At the time of closing the valve, when the drive current flowing through the solenoid 305 is cut off, a back electromotive force is applied to the solenoid 305, and the drive current is converged, the back electromotive force is gradually decreased. Therefore, the inductance is changed when the back electromotive force is decreased to generate an inflection point in the drive voltage.

That is, in the present specification, the inflection point serving as a sensing reference of the drive lift (actual drive lift) of the fuel injection valve 105, which appears in the drive current flowing through the solenoid 305 or in the drive voltage applied to the solenoid 305, is a point at which a temporal change in the inductance of the solenoid 305 is equal to or greater than a predetermined threshold value.

Next, with reference to FIGS. 8 and 9, the difference in generation of the inflection point of the fuel injection valve 105 due to the drive lift shown in FIG. 3 will be described.

FIG. 8 is a diagram showing an example in which a drive current flows through the solenoid 305 with the peak current Ip1, to drive with the low lift.

As described based on FIG. 4, when the fuel injection valve 105 is opened, the high voltage 210 is applied to the solenoid 305, and the current flows until the drive current reaches the peak current Ip1. When the drive current reaches the peak current Ip1, the high voltage 210 applied to the solenoid 305 is cut off and the battery voltage 209 is applied thereto. The movable core 1 301 is collided against the fixed core 304 in a state in which the drive current stably flows through the solenoid 305, and thus the movement direction of the movable core 1 301 is reversed. Therefore, the acceleration of the movable core 1 301 is changed abruptly, the inductance of the solenoid 305 is changed, and one inflection point 401 is generated in the drive current.

Meanwhile, when the fuel injection valve 105 is closed, after the injection pulse is turned off, the magnetic attractive force is decreased and the movable core 1 301 is moved away from the fixed core 304, and the movable core 1 301 and the valve body 303 are moved toward the valve seat 306. When the valve body 303 is in contact with the valve seat 306, the zero spring 309 is gradually compressed, but is changed to expansion upon seating, and thus the movement direction of the movable core 1 301 is reversed and the acceleration of the movable core 1 301 is abruptly changed. Due to the change in the acceleration of the movable core 1 301, the inductance of the solenoid 305 is changed and the back electromotive force is changed. Therefore, one inflection point 402 is generated in the drive voltage.

FIG. 9 is a diagram showing an example in which a drive current flows through the solenoid 305 with the peak current Ip2, to drive with the high lift.

As described based on FIG. 5, when the fuel injection valve 105 is opened, the high voltage 210 is applied to the solenoid 305 so that the current flows until the drive current reaches the peak current Ip2. Then, a magnetic attractive force is generated between the movable core 1 301 and the fixed core 304, and the movable core 1 301 and the movable core 2 302 are accelerated. When the drive current reaches the peak current Ip2, the high voltage 210 applied to the solenoid 305 is cut off, the flowing drive current is reduced to a predetermined value, and then the battery voltage 209 is applied to the solenoid 305. In a state where the drive current stably flows through the solenoid 305, the movable core 1 301 having a relatively short distance from the fixed core 304 is collided against the fixed core 304, and then the movable core 2 302 having a relatively long distance from the fixed core 304 is collided against the fixed core 304. In this way, when the movable core 1 301 and the movable core 2 302 are each sequentially collided against the fixed core 304, the acceleration is changed abruptly, and thus the inductance of the solenoid 305 is changed and two relatively large inflection points 501 and 502 are generated in the drive current.

Meanwhile, when the fuel injection valve 105 is closed, after the injection pulse is turned off, the magnetic attractive force is decreased, and the movable core 1 301 and the movable core 2 302 are moved away from the fixed cores 304. Since the movable core 2 302 having a smaller residual magnetic force is moved faster in the direction to the valve seat 306 compared to the movable core 1 301, first, the movable core 2 (302) is collided against the movable core 1 (301), and the acceleration of the movable core 1 (301) is abruptly changed. Thereafter, the movable core 1 301 and the movable core 2 302 begin to move simultaneously (integrally), and the valve body 303 is eventually brought into contact with the valve seat 306 and is closed. At that time, the zero spring 309 is gradually compressed, but is changed to expansion upon seating, and the acceleration of the movable core 1 301 and the movable core 2 302 is changed abruptly. Since this changes the inductance of the solenoid 305 and appears as a change in the back electromotive force, a relatively large inflection point 504 is generated in the drive voltage. That is, here, two inflection points are generated in the drive voltage, that is, the inflection point 503 generated by the collision between the movable core 2 302 and the movable core 1 301, and the inflection point 504 generated by the seating.

As described above, in the fuel injection valve 105 including a variable lift mechanism that moves a plurality of movable cores 1 and 2 301, 302 relatively in conjunction with the fixed core 304 or valve body 303, and that moves the valve body 303 stepwise to adjust the lift amount, at the time of low-lift driving, the number of inflection points appearing in the drive current due to the valve opening operation and the number of the inflection points appearing in the drive voltage due to the valve closing operation are both one, while, at the time of high-lift driving, the number of inflection points appearing in the drive current due to the valve opening operation and the number of inflection points appearing in the drive voltage due to the valve closing operation are both two.

Therefore, the drive sensing unit 212 of the fuel injection control device 127 may sense and monitor the actual drive lift (actual drive lift) of the fuel injection valve 105 from the number of inflection points detected by the inflection point detection unit 211, a way inflection points appear, and the like.

Next, the sensing of the actual drive lift of the fuel injection valve 105 and the drive lift limitation related to the injection amount control based on the sensing by the fuel injection control device 127 shown in FIG. 1 will be described using the flowchart of FIG. 10.

As shown in FIG. 10, first, in step S901, the inflection point is detected from the time series data of the drive current during the valve opening operation or the drive voltage during the valve closing operation of the fuel injection valve 105. Next, in step S902, sensing of the actual drive lift of the fuel injection valve 105 is performed. The actual drive lift may be sensed by specifying the operation characteristics of the high lift and the low lift from the inflection point detected in step S901. Next, determination of the actual drive lift is performed in step S903. It is determined whether or not the actual drive lift specified in step S902 matches the lift (command drive lift) commanded by the fuel injection drive waveform command unit 202. When the command drive lift and the actual drive lift match each other in step S903, this routine ends. Meanwhile, when the command drive lift and the actual drive lift do not match each other, the process moves to step S904, and limitation on the drive lift (command drive lift) is performed.

[Inflection Point Detection]

The inflection point detection by the inflection point detection unit 211 described above in step S901 will be described.

With the second-order differentiation of the time series data of the drive current flowing through the solenoid 305 or the drive voltage applied to the solenoid 305, the inflection point described above appears as an extreme value (maximum value or minimum value). Therefore, the inflection point described above may be specified by detecting the extreme values of the time series data.

FIG. 11 shows the time series data of a drive voltage during a valve closing operation at the time of high-lift driving and a second-order differential value thereof, FIG. 12 shows the time series data of a drive voltage during a valve closing operation at the time of low-lift driving and a second-order differential value thereof, FIG. 13 shows the time series data of a drive current during a valve opening operation at the time of high-lift driving and a second-order differential value thereof, and FIG. 14 shows the time series data of a drive current during a valve opening operation at the time of low-lift driving and a second-order differential value thereof.

When the S/N ratio of the measured drive current or the measured drive voltage is low and the noise level is high, it is difficult to sense the extreme value from the result of the second-order differentiation of the time series data of the drive current or the drive voltage. Therefore, a desired extreme value may be detected by applying a low-pass filter or the like to the drive current or the drive voltage and performing second-order differentiation on the smoothed time series data. The second-order differential value of the drive voltage and the second-order differential value of the drive current shown in FIGS. 11 to 14 are obtained by filtering the drive voltage and the drive current and performing second-order differentiation on the smoothed data.

In addition, when the second-order differentiation is performed on the time series data of the drive current from the time when the injection pulse is turned on, or on the time series data of the drive voltage from the time when the injection pulse is turned off, since an extreme value may appear at the time of voltage switching (for example, switching from high voltage 210 to battery voltage 209, or application of the back electromotive force after turn-off of the drive voltage) or the like, the inflection point generated by the acceleration change of the movable cores 1 and 2 301 and 302 cannot be accurately specified. Therefore, the time series data subject to the second-order differentiation is preferably the time series data of the drive current after a certain period of time elapses since the injection pulse is turned on (in other words, since the drive voltage or the drive current is turned on), or the time series data of the drive voltage after a certain period of time elapses since the injection pulse is turned off (in other words, since the drive voltage or the drive current is turned off).

[Actual Drive Lift Sensing]

Next, the actual drive lift sensing by the drive sensing unit 212 in step S902 will be described in detail with reference to FIGS. 15 to 18. In step S902, an actual drive lift is sensed using the extreme value detected in step S901.

{Method of Sensing Actual Drive Lift (Part 1)}

FIG. 15 shows an example in which second-order differentiation is performed with the drive voltage during the valve closing operation. As already described, there is a difference in the inflection point number (number of inflection points) between low-lift driving and high-lift driving. When driven with the high lift, the number of inflection points detected is two, while, when driven with the low lift, the number of inflection points is one. Since the inflection points appear as the extreme values, the number of inflection points may be specified by counting the number of extreme values from the second-order differential value. In other words, the actual drive lift when the number of extreme values is two (1501 and 1502) may be determined as a high lift (left side in FIG. 15), and the actual drive lift when the number of extreme values is one (1505) may be determined as a low lift (right side in FIG. 15). In the example shown in FIG. 15, every time the extreme value is counted (that is, every time the inflection point is detected), it is determined that the actual drive lift is sequentially increased. When counting the extreme values, the absolute value of the second-order differential value may be used. In addition, in order to prevent false detection of the extreme values, only when predetermined threshold values 1503 and 1504 are set, and the second-order differential value is equal to or greater than or equal to less than the predetermined threshold value, the value may be determined as an extreme value. The predetermined threshold value may be determined in advance by experiments, and may be set variably based on the fuel pressure value and the back electromotive force applied to the solenoid 305.

FIG. 15 shows the example of the drive voltage during the valve closing operation, but the same applies to the drive current during the valve opening operation.

{Method of Sensing Actual Drive Lift (Part 2)}

Further, a method of sensing an actual drive lift different from the method described above will be described with reference to FIG. 16.

Since the lift amount differs from each other between low-lift driving and high-lift driving, the time until the valve opening is completed after the injection pulse is turned on, and the time until the valve closing is completed after the injection pulse is turned off are relatively different from each other between the low lift and the high lift. At the time of low-lift driving with an amount of a relatively short lift, the time from when the injection pulse is turned on until generation of the inflection point occurring when the valve opening is completed, or the time from when the injection pulse is turned off until generation of the inflection point occurring when the valve closing is completed, is shorter compared to at the time of high-lift driving. Accordingly, when the time from when the injection pulse is turned on to the extreme value is shorter than the predetermined value, or when the time from when the injection pulse is turned off to the extreme value is shorter than a predetermined value 1602, the actual drive lift may be determined as a low lift (right side in FIG. 16), and when the time from when the injection pulse is turned on to the extreme value is longer than the predetermined value, or when the time from when the injection pulse is turned off to the extreme value is longer than the predetermined value 1602, the actual drive lift may be determined as a high lift (left side in FIG. 16). The predetermined value 1602 may be determined in advance by experiments, and may be set variably based on the fuel pressure value and the back electromotive force applied to the solenoid 305. In order to avoid false detection of the inflection points due to application of back electromotive force after the injection pulse is turned off, and the like, mask time 1601 is provided, and second-order differentiation is performed on the time series data after the mask time 1601 elapses.

The extreme value may be detected using the absolute value of the second-order differential value. In addition, in order to prevent false detection of the extreme values, only when predetermined threshold values 1603 and 1604 are set, and the second-order differential value is equal to or greater than or equal to less than the predetermined threshold value, the value may be determined as an extreme value. The predetermined threshold value may be determined in advance by experiments, and may be set variably based on the fuel pressure value and the back electromotive force applied to the solenoid 305.

FIG. 16 shows an example of the drive voltage during the valve closing operation, but the same applies to the drive current during the valve opening operation.

{Method of Sensing Actual Drive Lift (Part 3)}

Further, a method of sensing an actual drive lift different from the method described above will be described with reference to FIG. 17.

Since the lift amount is relatively different from each other between the low-lift driving and the high-lift driving, the acceleration of the movable cores 1 and 2 301 and 302 of the fuel injection valve 105 also differs depending on the drive lift. When the lift amount is relatively large (at the time of high-lift driving), the acceleration of the movable core is also relatively large, and the absolute value of the extreme value obtained by second-order differentiation is also relatively greater than the extreme value at the time of low-lift driving. Therefore, the actual drive lift may be estimated based on the magnitude of the absolute value of the extreme value. In other words, when the absolute values of the extreme values 1701 and 1702 are greater than the predetermined threshold value 1 1704, the actual drive lift may be determined as the high lift (left side in FIG. 17), and when the absolute value of the extreme value 1705 is less than the predetermined threshold value 11704, the actual drive lift may be determined as the low lift (right side in FIG. 17).

In addition, in order to prevent false detection of extreme values, only when a predetermined threshold value 2 1703 is set, and (the absolute value of) the second-order differential value is equal to or greater than the predetermined threshold value 2 1703, the value may be determined as an extreme value. The predetermined threshold value 2 or the predetermined threshold value 1 may be determined in advance by experiments, and may be set variably based on the fuel pressure value or the back electromotive force applied to the solenoid 305.

FIG. 17 shows an example of the drive voltage during the valve closing operation, but the same applies to the drive current during the valve opening operation.

In the example shown in FIG. 17, it is determined that the actual drive lift is greater, based on the magnitude of the extreme value, and more specifically, as the absolute value of the extreme value is greater. However, as described above, since the acceleration change of the movable core increases as the lift amount increases, a virtual drive voltage (drive voltage when it is assumed that there is no or a little abrupt acceleration change due to the collision of the movable core), or a virtual drive current (drive current when it is assumed that there is no or a little abrupt acceleration change due to the collision of the movable core) at the time of generation of the inflection point is assumed, a change amount (difference) of the actual drive voltage or the actual drive current with respect to the virtual drive voltage or the virtual drive current at the time of generation of the inflection point is calculated, when the change amount is relatively large, the actual drive lift may be determined to be the high lift, and when the change amount is relatively small, the actual drive lift may be determined to be the low lift.

{Method of Sensing Actual Drive Lift (Part 4)}

Further, a method of sensing an actual drive lift different from the method described above will be described with reference to FIG. 18.

In the low-lift driving and the high-lift driving, the directions of change in the acceleration of the movable cores 1 and 2 301 and 302 when the inflection point is generated are different from each other, and thus the directions (orientation) of the extreme value are also different from each other.

In the case of high-lift driving, at the inflection point that generates during the valve closing operation, since the magnetic attractive force is decreased after the injection pulse is turned off, the movable core 2 302 is moved in the direction of the valve seat 306, and is collided against the movable core 1 301. In this case, the acceleration of the movable core 1 301 is increased by applying a force in the movement direction of the movable core 1 301 due to the collision of the movable core 2 302. Meanwhile, when the valve is closed, the movement directions of the movable core 1 301 and the movable core 2 302 are reversed by the zero spring 309.

Meanwhile, in the case of low-lift driving, at the inflection point that generates during the valve closing operation, since the magnetic attractive force is decreased after the injection pulse is turned off, the movable core 1 301 is moved in the direction of the valve seat 306, and when the valve is closed, the movement direction of the movable core 1 301 is reversed by the zero spring 309.

In other words, the two inflection points that generate during valve closing operation at the time of high-lift driving are caused due to acceleration changes in the movement direction and acceleration changes in a direction opposite to the movement direction, and one inflection point that generates during the valve closing operation at the time of low-lift driving is caused only due to the acceleration change in the direction opposite to the movement direction.

As shown in FIG. 18, the inflection point caused due to the acceleration change in the movement direction at the time of high-lift driving is a minimum value 1801, and the inflection point caused due to the acceleration change in the direction opposite to the movement direction is a maximum value 1802. Further, at the time of low-lift driving, since the inflection point is caused due to acceleration change in the direction opposite to the movement direction, only a maximum value 1805 is obtained. By detecting this difference, the actual drive lift may be estimated, and accordingly, when the first detected extreme value is the minimum value 1801, the actual drive lift may be determined as the high lift, and when the first detected extreme value is the maximum value 1802, the actual drive lift may be determined as the low lift.

In the various sensing methods by the drive sensing unit 212 described above, when the actual drive lift is sensed with the number of inflection points (here, extreme values), there is an advantage that influence from the structure of the fuel injection valve 105, the control contents, and the like is low, and thus sensing accuracy is easily ensured.

[Actual Drive Lift Determination]

Next, the actual drive lift determination in step S903 in FIG. 10 will be described.

As already described, in step S903, it is determined whether or not the actual drive lift sensed in step S902 matches the command drive lift commanded by the fuel injection drive waveform command unit 202. When the actual drive lift and the command drive lift match each other, this routine ends.

Meanwhile, when the actual drive lift and the command drive lift do not match each other, the process moves to step S904 in order to perform the injection amount control. Moreover, the determination of match between the actual drive lift and the command drive lift may be performed once, and when the actual drive lift and the command drive lift do not match each other a plurality of times, the process may move to step S904.

[Drive Lift Limitation]

Next, the drive lift limitation by the fuel injection drive waveform command unit 202 in step S904 in FIG. 10 will be described in detail. In step S904, when the command drive lift described above does not match the actual drive lift, the command drive lift commanded by the fuel injection drive waveform command unit 202 is limited.

More specifically, when the command drive lift is the low lift and the actual drive lift is the high lift, the drive current is increased so that the high lift is constantly applied from the next fuel injection. Specifically, the drive voltage is applied so that the peak current Ip1 of the command drive current is Ip2. At that time, split injection is also limited so that the fuel can be injected with the minimum injection amount in the high lift. By limiting the split injection (for example, by prohibiting the split injection or limiting the number of splits) and constantly performing the high-lift driving, for example, the required fuel injection amount may always be satisfied, and fuel injection according to the target injection amount may be realized.

Further, when the command drive lift is the high lift and the actual drive lift is the low lift, the drive current is increased so that the high lift is constantly applied from the next fuel injection. Specifically, the drive current is increased so that the peak current is the maximum value (>Ip2), to ensure the high-lift driving. By constantly performing the high-lift driving, for example, the required fuel injection amount may always be satisfied, and fuel injection according to the target injection amount may be realized.

Further, when the command drive lift is the high lift and the actual drive lift is the low lift, the drive current maximum value may be set to the peak current Ip1 from the next fuel injection, and the driving may be limited to the driving with the low lift only.

As described above, although the inflection points generate due to changes in the acceleration of the movable core in the drive current during the valve opening operation and the drive voltage during the valve closing operation of the fuel injection valve 105, since the fuel injection valve 105 including a variable lift mechanism capable of varying the lift amount includes a plurality of movable cores, a plurality of inflection points are generated according to the operation of the movable core. Since these inflection points are determined according to the lift amount, it is possible to sense the actual drive lift (actually driven lift) by detecting the inflection points. Then, when the sensed actual drive lift is different from the command drive lift (commanded drive lift), the lift amount (command drive lift) may be limited and the fuel injection may be performed.

As described above, according to the fuel injection control device 127 according to the present embodiment, in the fuel injection valve 105 including a variable lift mechanism that varies the lift amount by a drive lift of a plurality of stages, since the lift amount (actual drive lift) of the fuel injection valve 105 can be accurately sensed, even when driven with a lift amount different from the intended lift amount (command drive lift) due to a malfunction of the fuel injection valve 105 or the like, it is possible to avoid significant deterioration of exhaust emission and unintended torque fluctuations.

In addition, the present invention is not limited to the embodiments described above, but includes various modified examples. For example, although the embodiment described above has been described in detail for easy understanding of the present invention, the present invention can also be applied to fuel injection valves capable of varying the lift amount in three stages or more, and fuel injection valves with different configurations such as a movable core, and since the method of generating the inflection point varies depending on the configuration of the movable core, the present invention is not necessarily limited to the one having all the configurations described above. Further, a part of the configuration of an embodiment can be replaced with the configuration of another embodiment, and the configuration of another embodiment can be added to the configuration of an embodiment. In addition, for a part of the configuration of each embodiment, addition, deletion, and replacement of other configurations are possible.

Each of the configurations, the functions, the processing units, the processing means, and the like described above may be realized by hardware by designing a part or all of those with, for example, an integrated circuit. Each of the configurations, the functions, and the like described above may be realized by software by interpreting and executing a program that realizes each function by the processor. Information such as a program, a table, a file, and the like that realizes each function may be stored in a storage device such as a memory, a hard disk, and a solid state drive (SSD), or a recording medium such as an IC card, an SD card, and DVD.

Further, the control lines and the information lines show those considered to be necessary for explanation, and all the control lines and information lines are not necessarily to be shown on the product. In practice, it may be considered that almost all the components are connected to each other.

REFERENCE SIGNS LIST

101: internal combustion engine
105: fuel injection valve
109: ECU
127: fuel injection control device (control device for a fuel injection valve)
201: fuel injection pulse signal calculation unit
202: fuel injection drive waveform command unit (current waveform correction unit)
203: engine state sensing unit
206: high voltage generation unit (boost device)
207*a*: fuel injection drive unit (Hi) (switch)
207*b*: fuel injection drive unit (Lo) (switch)
208: drive IC
211: inflection point detection unit
212: drive sensing unit
301: movable core 1
302: movable core 2
303: valve body
304: fixed core
305: solenoid
306: valve seat
307: valve hole

The invention claimed is:

1. A control device that controls a fuel injection valve including a variable lift mechanism that varies a lift amount of a valve body by a drive lift of two or more stages, wherein the control device for a fuel injection valve senses the drive lift of the fuel injection valve based on an inflection point detected from at least one of a drive current when the fuel injection valve is opened and a drive voltage when the fuel injection valve is closed; and wherein the inflection point serves as a reference associated with sensing the drive lift, and wherein the reference corresponds to a temporal change in an inductance associated with the fuel injection valve that is greater than or equal to a predetermined threshold value.

2. The control device for a fuel injection valve according to claim 1, wherein the control device for a fuel injection valve detects the inflection point from a drive voltage during a valve closing operation of the fuel injection valve or from a drive current during a valve opening operation, and senses the drive lift based on a number of detected inflection points.

3. The control device for a fuel injection valve according to claim 2, wherein the control device for the fuel injection valve determines that the drive lift increases with an increase in the number of detected inflection points.

4. The control device for a fuel injection valve according to claim 1, wherein the control device for the fuel injection valve detects the inflection point from a drive voltage during a valve closing operation of the fuel injection valve or from a drive current during a valve opening operation, and senses the drive lift based on a time from when the drive voltage or the drive current of the fuel injection valve is turned off to the detected inflection point, or a time from when the drive voltage or the drive current of the fuel injection valve is turned on to the detected inflection point.

5. The control device for a fuel injection valve according to claim 4, wherein the control device for the fuel injection valve determines that the drive lift increases with an increase in time.

6. The control device for a fuel injection valve according to claim 1, wherein the control device for the fuel injection valve detects the inflection point from a drive voltage during a valve closing operation of the fuel injection valve or from a drive current during a valve opening operation, and senses the drive lift based on a magnitude of an extreme value of the drive voltage or the drive current at a time of generation of the inflection point.

7. The control device for a fuel injection valve according to claim 6, wherein the control device for the fuel injection valve determines that the drive lift increases with an increase in an absolute value of the extreme value.

8. The control device for a fuel injection valve according to claim 1, wherein the control device for the fuel injection valve detects the inflection point from a drive voltage during a valve closing operation of the fuel injection valve or from a drive current during a valve opening operation, and senses the drive lift based on an orientation of an extreme value of the drive voltage or the drive current at a time of generation of the inflection point.

9. The control device for a fuel injection valve according to claim 1, wherein the control device for the fuel injection valve detects the inflection point from the drive voltage after a predetermined elapsed time elapses since from when the drive voltage or the drive current of the fuel injection valve is turned off, or from the drive current after a predetermined elapsed time from when the drive voltage or the drive current of the fuel injection valve is turned on.

10. The control device for a fuel injection valve according to claim 1, wherein when the sensed drive lift is different from a command drive lift commanded to the fuel injection valve, the control device for a fuel injection valve limits the command drive lift.

11. The control device for a fuel injection valve according to claim 10, wherein when the fuel injection valve is driven with a first lift amount despite a command to perform the drive lift with a second lift amount that is lower than the first lift amount, the control device for the fuel injection valve controls the command drive lift so that the lift amount of the fuel injection valve is constantly higher than the second lift amount.

12. The control device for a fuel injection valve according to claim 10, wherein when the fuel injection valve is driven with a second lift amount despite a command to perform the drive lift with a first lift amount higher than the second lift amount, the control device for a fuel injection valve limits controls the command drive lift so that the lift amount of the fuel injection valve is constantly higher than the second lift amount.

13. A control device that controls a fuel injection valve including a variable lift mechanism that varies a lift amount of a valve body by a drive lift of two or more stages, the control device comprising:

an inflection point detector that detects an inflection point from at least one of a drive current when the fuel injection valve is opened and a drive voltage when the fuel injection valve is closed; and a drive sensor that senses a drive lift of the fuel injection valve based on the inflection point detected by the inflection point detector;

wherein the inflection point serves as a reference associated with sensing the drive lift, and wherein the reference corresponds to a temporal change in an inductance associated with the fuel injection valve that is greater than or equal to a predetermined threshold value.

14. The control device for a fuel injection valve according to claim 13, further comprising:

a fuel injection controller that controls a command drive lift commanded to the fuel injection valve based on the drive lift sensed by the drive sensor.

15. The control device for a fuel injection valve according to claim 14, wherein the fuel injection controller limits the command drive lift when the drive lift sensed by the drive sensor is different from the command drive lift commanded to the fuel injection valve.

16. The control device for a fuel injection valve according to claim 13, wherein sensing the drive lift is based, at least in part, on a number of the detected inflection points.

17. The control device for a fuel injection valve according to claim 16, wherein the drive sensor determines that the drive lift increases with an increase in the number of detected inflection points.

18. The control device for a fuel injection valve according to claim 13, wherein the drive sensor senses the drive lift based, at least in part, on a time from when the drive voltage or the drive current of the fuel injection valve is turned off to the detected inflection point, or a time from when the drive voltage or the drive current of the fuel injection valve is turned on to the detected inflection point.

19. The control device for a fuel injection valve according to claim 18, wherein the drive sensor determines that the drive lift increases with an increase in time.

20. The control device for a fuel injection valve according to claim 13, wherein the drive sensor senses the drive lift based on a magnitude of an extreme value of the drive voltage or the drive current at a time of generation of the inflection point.

* * * * *